US007461606B2

(12) United States Patent
Ota et al.

(10) Patent No.: US 7,461,606 B2
(45) Date of Patent: Dec. 9, 2008

(54) FEED GENERATING DEVICE FOR SEWING MACHINE

(75) Inventors: Shin Ota, Inazawa (JP); Minoru Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 389 days.

(21) Appl. No.: 11/258,878

(22) Filed: Oct. 27, 2005

(65) Prior Publication Data

US 2006/0090681 A1 May 4, 2006

(30) Foreign Application Priority Data

Oct. 28, 2004 (JP) ..... 2004-313435
Oct. 28, 2004 (JP) ..... 2004-313958

(51) Int. Cl.
*D05B 3/04* (2006.01)
*D05B 27/00* (2006.01)

(52) U.S. Cl. ..... 112/462

(58) Field of Classification Search ..... 112/157, 112/454, 458, 1, 466, 220, 323
See application file for complete search history.

(56) References Cited

U.S. PATENT DOCUMENTS 4,368,681 A * 1/1983 Hanyu et al. ..... 112/462
4,428,311 A * 1/1984 Sano ..... 112/466
4,463,694 A * 8/1984 Sano ..... 112/462
6,948,438 B2 * 9/2005 Takahashi et al. ..... 112/458

FOREIGN PATENT DOCUMENTS

JP A 2000-167273 6/2000

* cited by examiner

*Primary Examiner*—Ismael Izaguirre
(74) *Attorney, Agent, or Firm*—Oliff & Berridge, PLC

(57) ABSTRACT

A feed generating device for a sewing machine capable of selectively sewing one of a plurality of utility patterns and a plurality of super patterns including a single super feed cam generating a cloth feed for sewing the super pattern, a single or a plurality of feed contacts capable of contacting the super feed cam and a switching mechanism that moves the feed contact to a plurality of contact locations having different swing phases with respect to the super feed cam. The cloth feed for sewing the super pattern is a combination of a forward feed and a backward feed and by moving the feed contact to either one of a plurality of contact locations by the switching mechanism, cloth feed including different patterns of combination of the forward feed and the backward feed are generated.

7 Claims, 34 Drawing Sheets

FEED GENERATING DEVICE FOR SEWING MACHINE

CROSS-REFERENCE TO RELATED APPLICATIONS

This application is based upon and claims the benefit of priority from the prior Japanese Patent Application Nos. 2004-313958, filed on Oct. 28, 2004 and 2004-313435, filed on Oct. 28, 2004 the entire contents of both of which are incorporated herein by reference.

TECHNICAL FIELD

The disclosure relates to a feed generating device of a sewing machine capable of selectively sewing any pattern among a plurality of utility patterns and a plurality of super patterns.

BACKGROUND

A conventional mechanically-driven zigzag sewing machine is provided with a pattern selection dial for selecting one of a plurality of utility patterns such as a straight pattern and a zigzag pattern; and a plurality of needle swinging cams and a plurality of feed cams corresponding to the plurality of utility patterns. In the aforementioned zigzag sewing machine, when a desired pattern is selected by manually rotating the pattern selection dial, a contact respectively contacts the needle swinging cam and a feed cam that correspond to the selected pattern. Thus, applicable needle swinging movement and the cloth feed movement are executed so that the desired utility pattern is formed on the workpiece cloth.

Recently, various types of sewing machines capable of sewing a super pattern by cyclically executing a backward cloth feed (reverse feed) within a sequence forward cloth feed (normal feed) have been suggested. One example of the super pattern is a smocking pattern.

Such sewing machines are provided, for example, with a feed generating device as described below. That is, the feed generating device is provided with a plurality of zigzag feed cams controlling a feed amount of the utility pattern; two super feed cams to control a feed amount of the super pattern; and a single feed follower contacting either one of the feed cams. The aforementioned zigzag feed cams and the super feed cams are stacked in the rotational shaft direction. Additionally, a feed releasing mechanism is provided so that whenever the feed cams are switched in response to the operation of the pattern selection dial, the feed follower is released from the previously selected feed cam and the utility pattern or the super pattern currently selected by the pattern selection dial can be sewn.

The above-described feed generating device is disclosed on pages 5 to 10, FIGS. 2 to 7 of the Japanese Unexamined Patent Publication 2000-167273.

However, the above feed generating device is provided with two super feed cams thereby requiring a large arrangement space. Also, since additional space is required for the feed releasing mechanism, the overall size of the feed generating device is increased.

Furthermore, the force required for manually operating the pattern selection dial increases in proportion to the increase in the number of feed cams thereby deteriorating the operability. Therefore, provision of an operation dial for selecting the super pattern apart from the pattern selection dial can be conceived so that operability of the pattern selection dial can be improved by decreasing the number of selectable patterns by the pattern selection dial. However, in such a case, a feed releasing mechanism operating in conjunction with the super pattern operation dial would be required, which is another problem.

SUMMARY

A purpose of the disclosure is a size reduction and an operability improvement of a feed generating device of a sewing machine capable of sewing a plurality of utility patterns and a plurality of super patterns.

The disclosure relates to a feed generating device of a sewing machine capable of selectively sewing one of a plurality of utility patterns and a plurality of super patterns comprising: a single super feed cam generating a cloth feed for sewing the super pattern; a a plurality of feed contacts arranged so as to be capable of contacting the super feed cam in either one of a plurality of contact locations having different swing phases with respect to the super feed cam: and a switching mechanism that moves the feed contact to the contact locations. The cloth feed for sewing the super pattern is a combination of a forward feed and a backward feed and by moving the feed contact to any one of a plurality of contact locations by the switching mechanism, cloth feeds having different patterns of combinations of the forward feed and the backward feed are generated.

In such a case, the feed contact may be constructed by a Single feed contact movable to a plurality of contact locations; or a plurality of feed contacts arranged to be capable of contacting the super feed cam in a plurality of contact locations.

BRIEF DESCRIPTION OF THE DRAWINGS

Other objects, features and advantages of the present invention will become clear upon reviewing the following description of the illustrative aspects with reference to the accompanying drawings, in which.

DETAILED DESCRIPTION OF THE INVENTION

A first embodiment, applying the present invention to a zigzag sewing machine is described hereinafter with reference to FIGS. 1 to 19.

Figure 1:
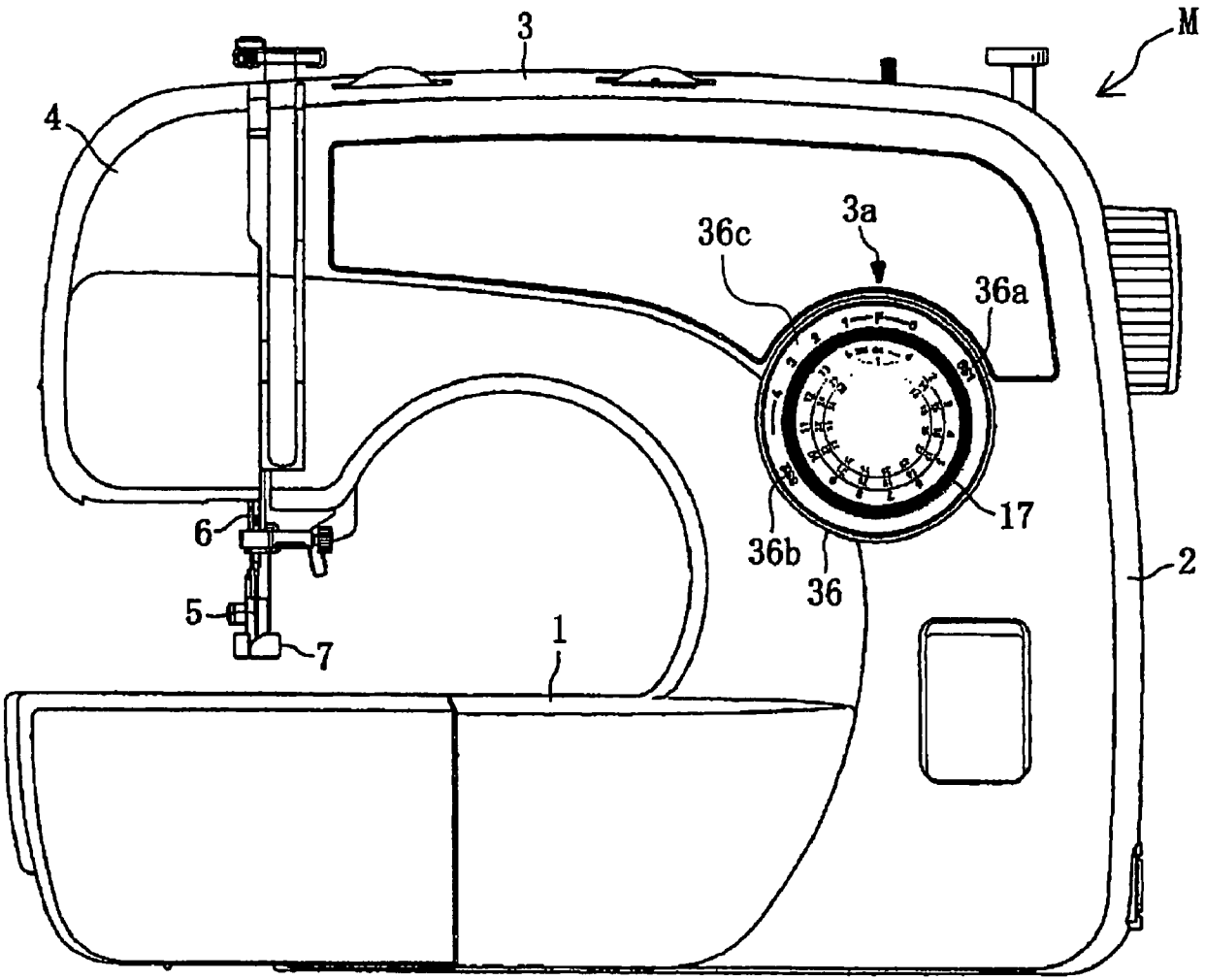
FIG. 1 shows a front view of a zigzag sewing machine according to a first illustrative aspect of the invention.
Figure 2:
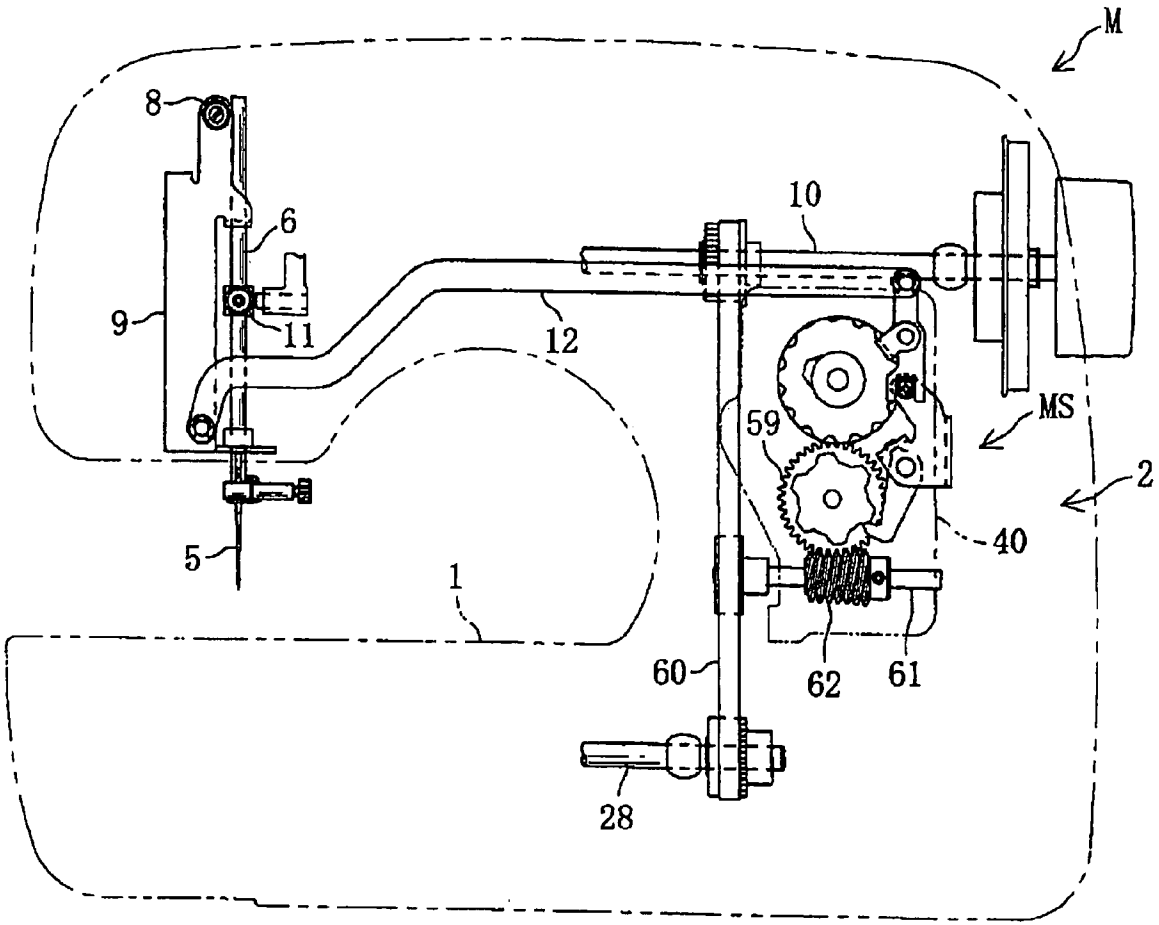
FIG. 2 shows a front view of an inner construction of the zigzag sewing machine.

First, a schematic construction of the zigzag sewing machine according to the present invention is described. As shown in FIGS. 1 and 2, a zigzag sewing machine M is provided with a bed 1, a pillar 2 standing on a right end of the bed 1 and an arm 3 extending horizontally to the left from an upper end of the pillar 2 as to oppose the bed 1. The arm 3 includes a head 4 on which are provided a vertically extending needle bar 6 and a presser bar (not shown). The needle bar 6 has a lower end on which a sewing needle 5 is detachably attached and a lower end to which a presser foot 7 is attached.

A needle bar support member 9 is swingably supported by the machine frame via a pin 8 inside the head 4, whereas the needle bar 6 is supported vertically movably and also swingably to the needle bar support member 9. A main shaft 10 is provided inside the arm 3 so as to extend horizontally and supported rotatably to the sewing machine. The main shaft 10 is rotationally driven to a prescribed rotational direction by a sewing machine motor (not shown). The needle bar 6 is vertically moved via a needle bar clamp 11 by a needle bar vertically moving mechanism (not shown) connected to the main shaft 10, as well as swinging along with the needle bar support member 9 via a swinging rod 12 linked to a needle swinging mechanism explained thereinafter.

Figure 4:
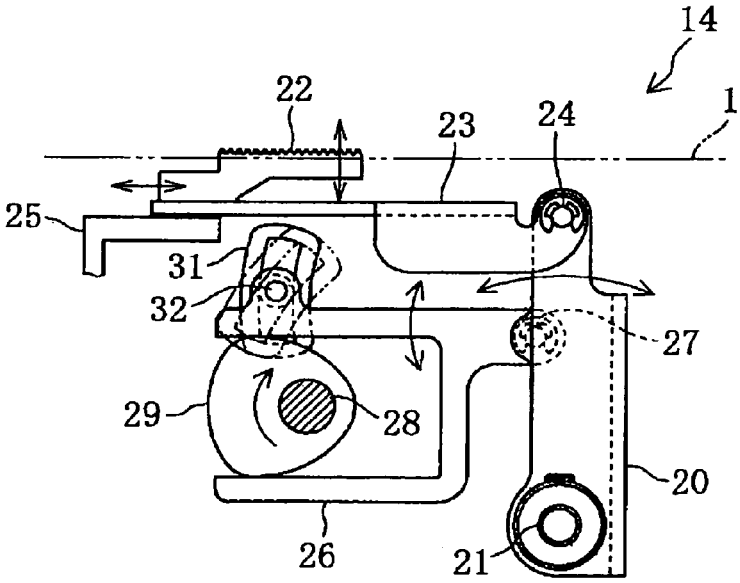
FIG. 4 shows a left side view of the feed dog driving mechanism.
Figure 5:
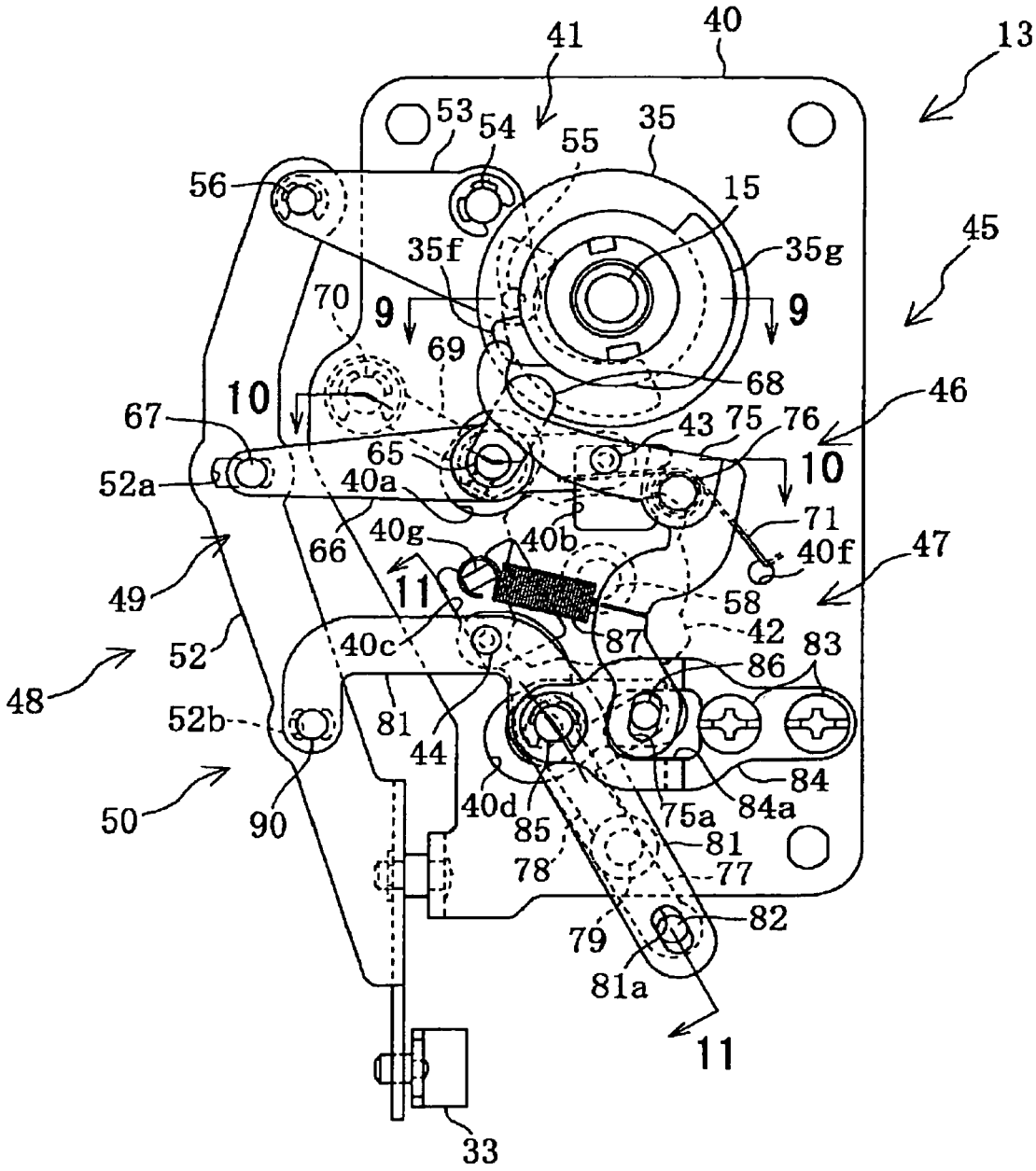
FIG. 5 shows a front view of a feed generating device.

A pattern selection device MS is provided in the pillar 2 and the bed 1. Though details not shown, the pattern selection device MS is provided with a needle swinging cam group integrally stacking a plurality of needle swinging cams; a needle swinging contact moving mechanism (the so called needle swinging release mechanism) that moves a single needle swinging contact in the direction of stack of the needle swinging cams so as to be paired with any of the needle swinging cams; and a needle swinging mechanism to convert a swing of the needle swinging contact to a swing of the needle bar 6. The pattern selection device MS is further provided with a feed generating device 13 that generates a fabric feed movement by swinging feed contacts 43, 44 and 55 (all of which are shown in FIG. 5), a feed dog driving mechanism 14 for executing the generated fabric feed movement (refer to FIGS. 3 and 4) and a feed regulator to adjust the amount of fabric feed and so forth.

Figure 3:
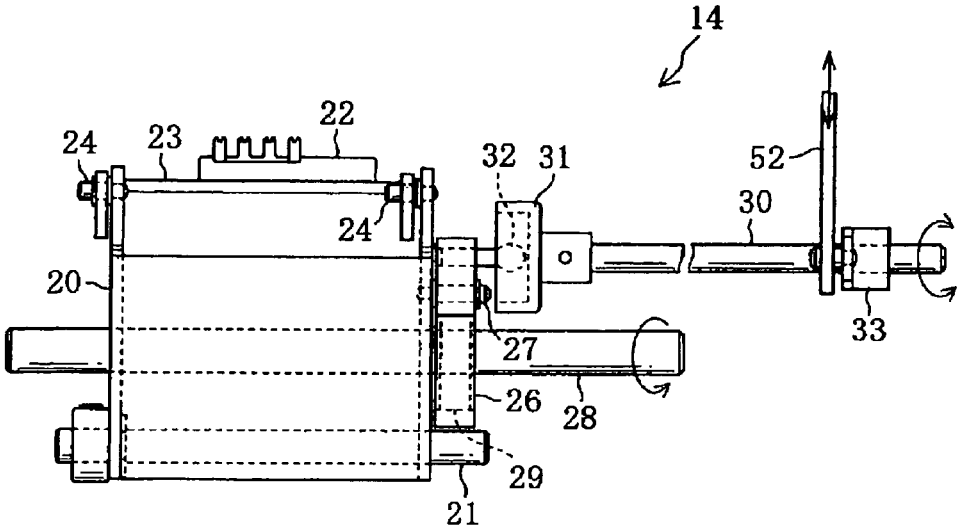
FIG. 3 shows a front view of a feed dog driving mechanism.

The feed dog drive mechanism 14 is provided in the bed 1. As shown in FIGS. 3 and 4, a horizontal feed actuator 20 of substantial width is arranged inside the bed 1 located below the sewing needle 5. The lower end of the horizontal feed actuator 20 is swingably supported by a support shaft 21 extending laterally. A feed dog support 23 to which a feed dog 22 is fixed is linked to the upper end of the horizontal feed actuator 20 by a pin 24. The rear end of the feed dog support 23 is connected to a vertically actuating member 25 of the feed dog vertically moving mechanism (not shown) and the feed dog 22 is vertically moved via the feed dog support 23.

The front end of a substantially U-shaped horizontal feeder 26 is supported via a support pin 27 on a side wall of the horizontal feed actuator 20. Thus the horizontal feeder 26 is arranged to be swingable in the vertical direction. A triangular horizontal feed cam 29 is provided inside the horizontal feeder 26. The horizontal feed cam 29 is fixed to a feed shaft 28 rotationally driven in synchronization with the main shaft 10.

On the other hand, a laterally extending rotary shaft 30 is arranged immediately above the feed shaft 28. A feed regulator 31 is fixed on the left end of the rotary shaft 30. A curved feed adjustment hole (not shown) is formed inside the feed regulator 31 and an end point of a feed adjustment pin 32 fixed to the horizontal feeder 26 is fitted in the feed adjustment hole.

The rear end of a feed conveying lever 33 is linked to the rotary shaft 30. The lower end of a feed generating plate 52 downwardly extending from the feed generating device 13 is linked to the front end of the feed conveying lever 33. When the feed generating plate 52 is located in the middle of the vertical movement range thereof, the inclination of the feed regulator 31 is set in the standard orientation as shown in a solid line in FIG. 4. At this point, since the inclination of the feed regulator 31 matches with the movement locus of the adjustment pin 32, the feed dog 22 is not moved in the horizontal direction by the horizontal feeder 26 and the horizontal feed actuator 20, hence the cloth feed amount is "zero".

On the other hand, when the feed generating plate 52 moves below the middle of the vertical movement range, the inclination of the feed regulator 31 is switched to a backward feed orientation (reverse feed orientation) as shown in a two-dot chain line. Thus, the feed dog 22 is moved in the horizontal direction by the horizontal feeder 26 and the horizontal feed actuator 20 and the workpiece cloth is fed backward (backward feed).

Also, when the feed generating plate 52 moves above the middle position, the inclination of the feed regulator 31 is switched to a forward feed orientation (normal feed orientation). Thus, the work cloth is fed forward by the feed dog 22 (forward feed).

The feed generating device 13 is arranged in the pillar 2. As shown in FIG. 5, the feed generating device 13 includes a base frame 40 made of a plate member in a substantially oblong form; a utility feed generating mechanism 41 provided on the base frame 40; a super feed cam 42; a first and second super feed contacts 43 and 44; a contact switching mechanism 45 that makes a switch so that either first or second super feed contact 43 or 44 contacts the super feed cam 42; and a super feed generating mechanism 48. The utility feed generating mechanism 41 generates the cloth feed movement for the utility patterns whereas the super feed generating mechanism 48 generates the cloth feed movement for the super patterns.

The base frame 40 is arranged in the vertical direction inside the pillar 2, with a plurality of portions thereof fixed to the sewing machine frame. On the base frame 40 are formed a first, a second, a third and a fourth opening 40*a* to 40*d* of various forms such as an oval, an oblong form or the like.

As shown in FIGS. 1 to 9, a cylindrical support 40*e* is formed on the upper front surface of the base frame 40. A longitudinally extending selection cam shaft 15 is inserted through the support 40*e* and rotatably supported thereby.

The selection cam shaft 15 penetrates onto the back side of the base frame 40 and passes through a pattern selection cam 16. A first fixing pin 18*a* is fixed to the rear end of the selection cam shaft 15. The first fixing pin 18*a* is engaged with a groove (not shown) provided on the rear end of the pattern selection cam 16. Hence the pattern selection cam 16 rotates together with the selection cam shaft 15.

Also, a first retaining ring 37*a* is fixed on the selection cam shaft 15 in the portion located in the front end of the support 40*e*. The pattern selection cam 16 and the support 40*e* are held between the first retaining ring 37*a* and the first fixing pin 18*a*, therefore the selection cam shaft 15 cannot be moved in the shaft direction.

Furthermore, a switch control cam 35 is rotatably supported on the outer circumference of the support 40*e*. The selection cam shaft 15 passes through a feed dial 36 rotatably located in front of the support 40*e* and in front of the feed dial 36, a second retaining ring 37*b* is fixed. Owing to such construction, the feed dial 36 held in between the first and the second retaining rings 37*a* and 37*b* is unmovable in the shaft direction and the switch control cam held in between the base frame 40 and the first retaining ring 37*a* is unmovable in the shaft direction. Also, the switch control cam 35 is engaged with an undulated engagement (not shown) formed on the feed dial 36. Hence the switch control cam 35 and the feed dial 36 can be rotated together.

A pattern selection dial 17 is fixed on the front end of the selection cam shaft 15. On the rear surface of the pattern selection dial 17, a cylindrical portion 17*a* is formed on the rear surface of the pattern selection dial 17, and the front end of the selection cam shaft 15 is fitted therein. A second fixing pin 18*b* fixed to the selection cam shaft 15 is engaged with a groove (not shown) provided on the rear end of the cylindrical portion 17*a*. Therefore, the pattern selection dial 17 rotates together with the selection cam shaft 15.

The pattern selection dial 17 is located in front of the feed dial 36 and is of a smaller diameter than the feed dial 36. The pattern selection dial 17 and the feed dial 36 rotate independently without affecting the other. Therefore, only the switch control cam 35 can be rotated by the rotational operation of the feed dial 36 and only the pattern selection cam 16 can be rotated via the selection cam shaft 15 by the rotational operation of the pattern selection dial 17.

Figure 19:
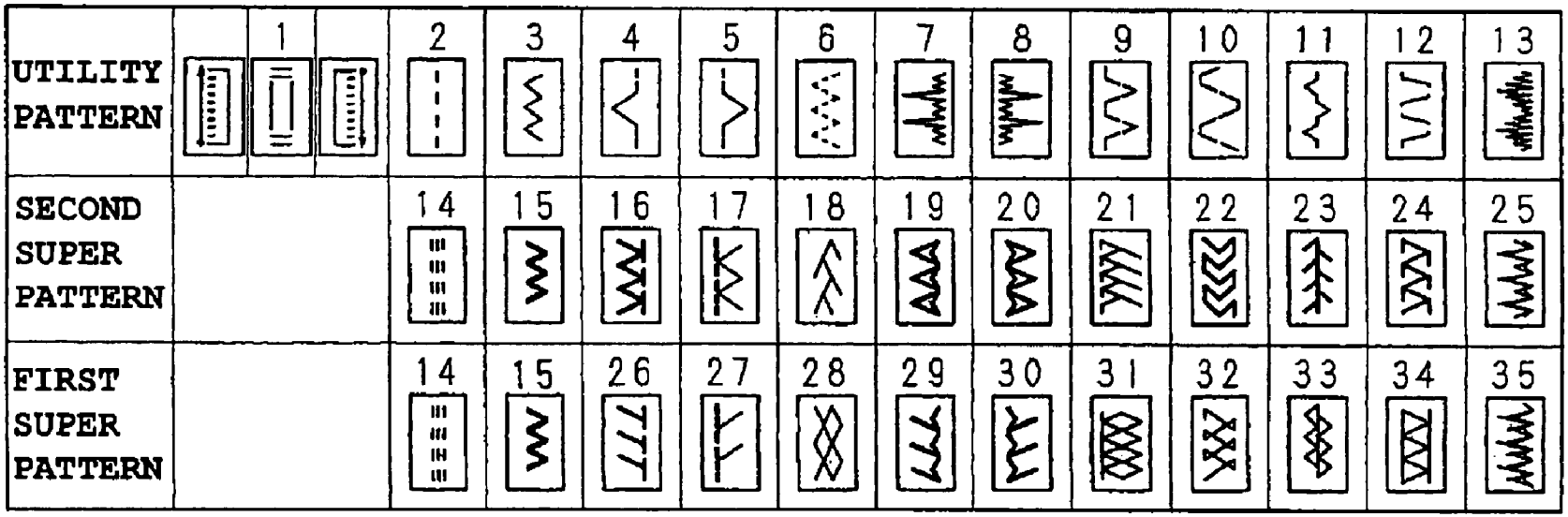
FIG. 19 shows a table indicating stitch forms and the corresponding numbers for the utility patterns and the first and the second super patterns.

The pattern selection dial 17 and the feed dial 36 protrude towards the front of the pillar 2 via an opening 2*a* provided in the front surface of the pillar 2. Numbers indicating a plurality of utility patterns and a plurality of super patterns that can be sewn are marked on the front surface of the pattern selection dial 17. FIG. 19 shows the numbers and the corresponding stitch forms for the utility patterns and the super patterns.

First and second selection operators 36*a* and 36*b* for selecting super patterns and a cloth feed amount setter 36*c* for utility patterns are provided on the feed dial 36 on the portion located on the outer circumference of the pattern selection dial 17. The first and the second selection operators 36*a* and 36*b* are located symmetrically about the rotational center of the feed dial 36 and the cloth feed amount setter 36*c* is located in between the first and the second selection operators 36*a* and 36*b*.

Characters "SS1" and "SS2" indicating the first and the second super patterns are marked on the front surface of the first and the second operators 36*a* and 36*b* respectively. Also, numerics and characters "0", "F", "1"—"4" indicating the cloth feed amount are marked on the front surface of the cloth feed amount setter 36*c*. A triangular selection mark 3*a* is marked on the front surface of the arm 3. By adjusting the numbers marked on the pattern selection dial 17 to the selection mark 3*a*, the selection of one of a plurality of utility patterns and super patterns can be made. Also, the cloth feed amount of the utility pattern or the type of super pattern can be selected (either the first or the second super pattern) by adjusting the various characters marked on the feed dial 36 to the selection mark 3*a*.

Therefore, the cloth feed amount setter 36*c* corresponds to the "setting range" of the cloth feed amount of utility patterns.

Figure 6:
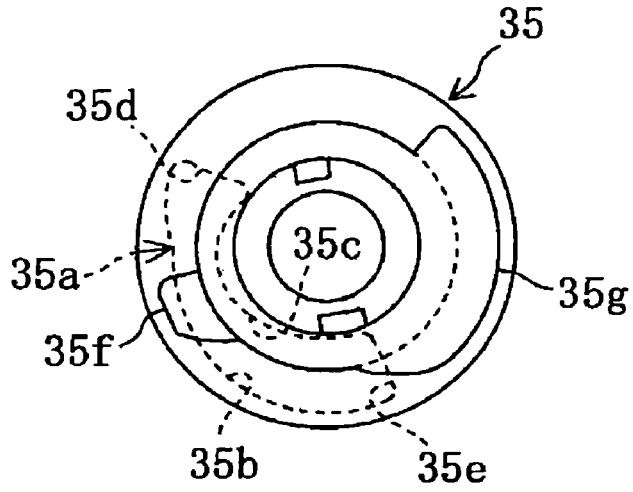
FIG. 6 shows a front view of a switch control cam.
Figure 7:
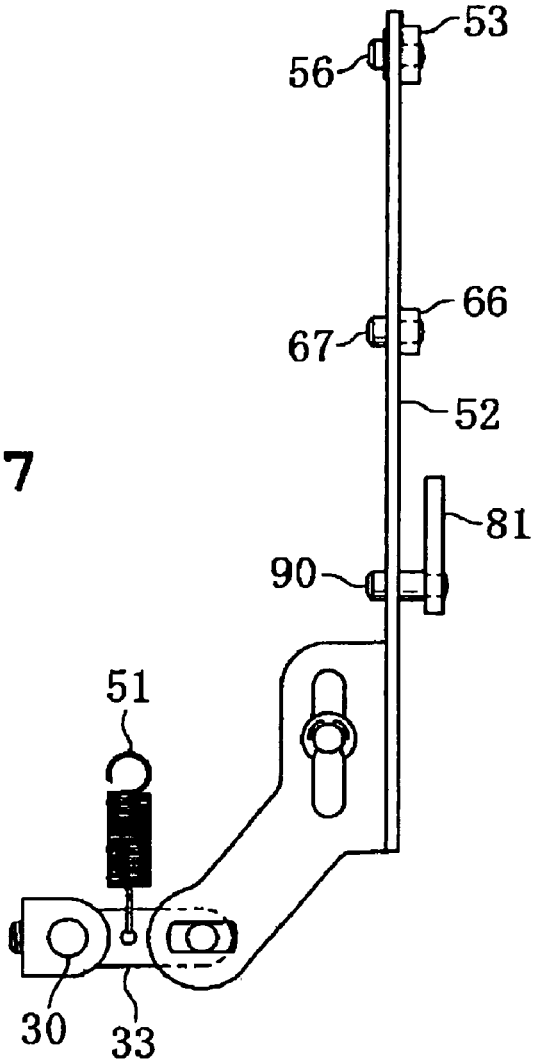
FIG. 7 shows a left side view of a feed generating device.
Figure 13A:
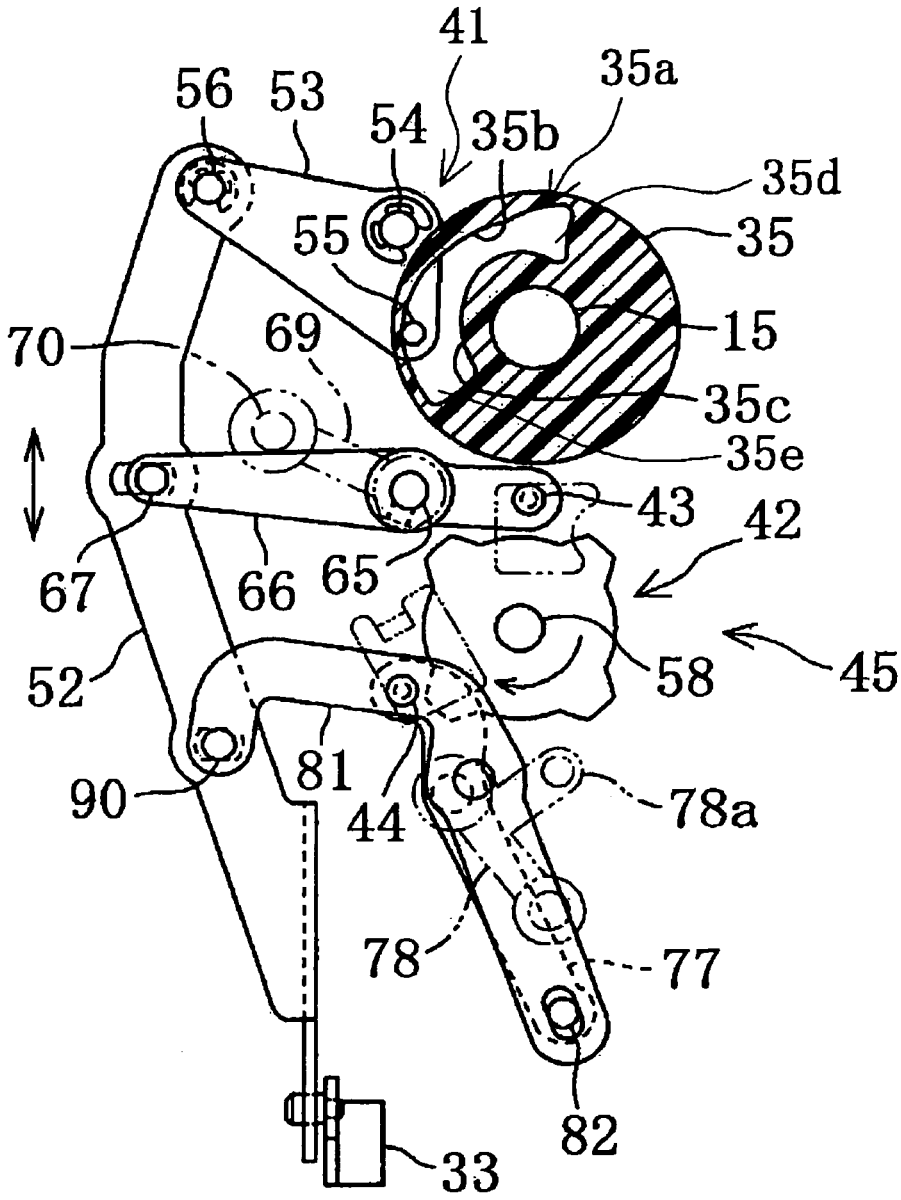
FIG. 13A shows a front view of the feed generating device upon forward cloth feed for a utility pattern.

Next, the utility feed generating mechanism 41 is described with reference to FIGS. 5, 6 and 13A. A utility feed cam 35*a* forming a recess curved along the outer circumference of the utility feed cam 35*a* is provided on the rear surface of the switch control cam 35. A normal feed cam surface 35*b* for forward feed and a reverse feed cam surface 35*c* for backward feed are respectively formed on the inner surfaces of the utility feed cam 35*a* opposing one another in the radial direction. Also, retraction areas 35*d* and 35*e* are respectively formed on both ends in the circumferential direction of the utility feed cam 35*a*.

A triangular utility feed lever 53 is rotatably supported via a pin 54 in the left portion of the base frame 40 near the switch control cam 35. The right end of the utility feed lever 53 is located between the switch control cam 35 and the base frame 40. A utility feed contact 55 approaching the utility feed cam 35*a*is fixed on the front surface of the right end of the utility feed lever 53. Also, the upper end of the feed generating plate 52 is rotatably linked by a link pin 56 to the left end of the utility feed lever 53. The feed generating plate 52 is a member elongated in the vertical direction and is permanently elastically energized in the upward direction by a helical extension spring 51 (refer to FIG. 7). Hence, the utility feed contact 55 normally contacts the normal feed cam surface 35*b*.

The contact location of the utility feed contact 55 with respect to the normal feed cam surface 35*b* is changed when the feed dial 36 is rotationally operated and the switch control cam 35 is rotated together with the feed dial 36. Then the utility feed lever 53 is rotated clockwise or counterclockwise changing the height of the feed generating plate 52 thereby changing the forward feed amount. When a back-tack is to be formed at a final stage of sewing, the feed generating plate 52 is forcibly lowered in resistance to the spring force of the helical extension spring 51. Consequently, the utility feed contact 55 contacts the reverse feed cam surface 35*c*. As a result, back-tacking is enabled by switching to the backward feed.

When the cloth feed for super patterns explained thereinafter is to be generated, the utility feed contact 55 is retracted to the retraction areas 35*d* and 35*e* so as not to contact the normal feed cam surface 35*b* or the reverse feed cam surface 35*c*.

Next, the super feed cam 42 is described with reference to FIGS. 5, 8, 10 and 12. The super feed cam 42 is arranged immediately behind the base frame 40 and is rotatably supported to the base frame 40 by a shaft 58. A worm wheel 59 is integrally provided on the rear surface of the super feed cam 42.

The worm wheel 59 is engaged with a worm gear 62 provided on a worm gear shaft 61. The rotation of the main shaft 10 is conveyed to the worm gear shaft 61 by a timing belt 60 (refer to FIG.2). Therefore, when the main shaft 10 is rotated, the worm wheel 59, that is, the super feed cam 42, are simultaneously rotated by way of the worm gear 62 counterclockwise in synchronization with the vertical movement of the needle bar 6.

The super feed cam 42 has 4 backward cam surfaces 42*a* formed in 90° intervals and forward cam surfaces 42*b*formed between the backward cam surfaces 42*a*. When the super feed cam 42 is rotated in synchronization with the rotation of the main shaft 10 and later described first or second super feed contact 43 or 44 contacts the forward cam surface 42*b*, 2 stitches of forward feed are executed whereas when passing over the backward cam surface 42*a*, 1stitch of backward feed is executed. That is, the sewing machine M according to the present embodiment sews the super patterns by combinations of cloth feed movements comprising two stitches of forward feed and 1stitch of backward feed.

Next, a contact switching mechanism 45 is described. The contact switching mechanism 45 selectively switches the first super feed contact 43 and the second super feed contact 44 so that either the first or the second super feed contact contacts the super feed cam 42. The contact switching mechanism 45 is provided with a first switching mechanism 46 that causes the first super feed contact 43 to contact with the super feed cam 42 for sewing the first super pattern (refer to FIG. 19) and a second switching mechanism 47 that causes the second super feed contact 44 to contact with the super feed cam 42 for sewing the second super pattern (refer to FIG. 19).

Figure 10:
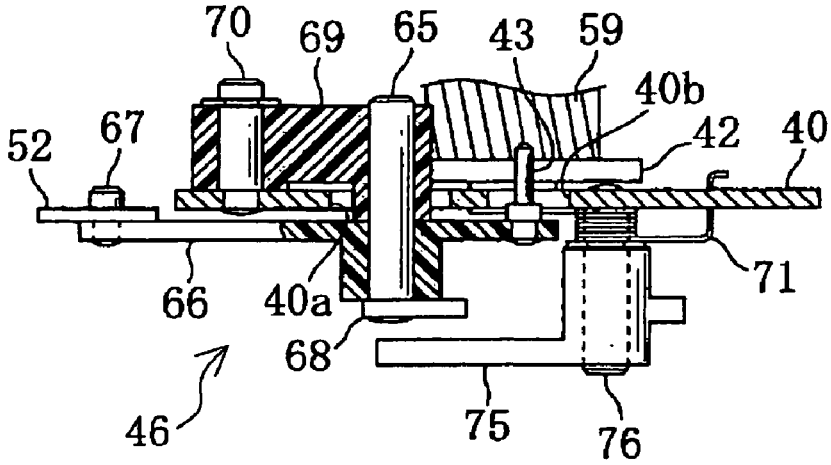
FIG. 10 shows a transverse sectional view taken along line 10-10 in FIG. 5.

The first switching mechanism 46 is constructed as follows. That is, as shown in FIGS. 5 and 10, a link shaft 65 extending in the longitudinal direction is arranged in the first opening 40*a* located in the central portion in the height direction of the base frame 40. A first cam detection lever 66 extending in the lateral direction is rotatably supported near the center thereof by a portion of the link shaft 65 located in front of the base frame 40.

The first super feed contact 43 extending in the longitudinal direction is arranged in a second opening 40*b* of the base frame 40. The front end of the first super contact 43 is fixed on the right end of the first cam detection lever 66. A link pin 67 is fixed on the left end of the first cam detection lever 66. The link pin 67 is engaged to a first engagement hole 52*a* of the feed generating plate 52.

The lower end of a first cam contacting lever 68 of an oval shape is fixed on the front end of the link shaft 65. The right end of a first lever support 69 is fixed on the rear of the link shaft 65 to form a predetermined angle (for example, approximately 90°) with the first cam contacting lever 68. The left end of the first lever support 69 is rotatably supported on the base frame 40 by a support pin 70.

A support shaft 76 is fixed on the vertical center of the front surface of the base frame 40. The support shaft 76 supports -a second cam contacting lever 75 of the later described second switching mechanism. A torsion spring 71 is wound on the support shaft 76. One end of the torsion spring 71 is locked by the first super feed contact 43 from below and the other end of the torsion spring is locked to the lock hole 40*f* of the base frame 40. Hence, the entire first cam detection lever 66 in a supported state by the first engagement hole 52*a* by way of the link pin 67 is energized upward by the spring force of the torsion spring 71.

A first switching cam 35*f* is provided in a protruding form on the front surface of the switch control cam 35. In case the cloth feed amount (cloth feed amount: 1, 2, 3, 4) for the utility pattern is selected (refer to FIGS. 5, 13B and 14B) or the second super pattern (SS2) is selected (FIGS. 17B and 18B) by the feed dial 36, the first cam contacting lever 68 does not contact the first switching cam 35*f*. Therefore, since the first cam detection lever 66 is urged upward by the torsion spring 71, the first super feed contact 43 does not contact the super feed cam 42.

Figure 15A:
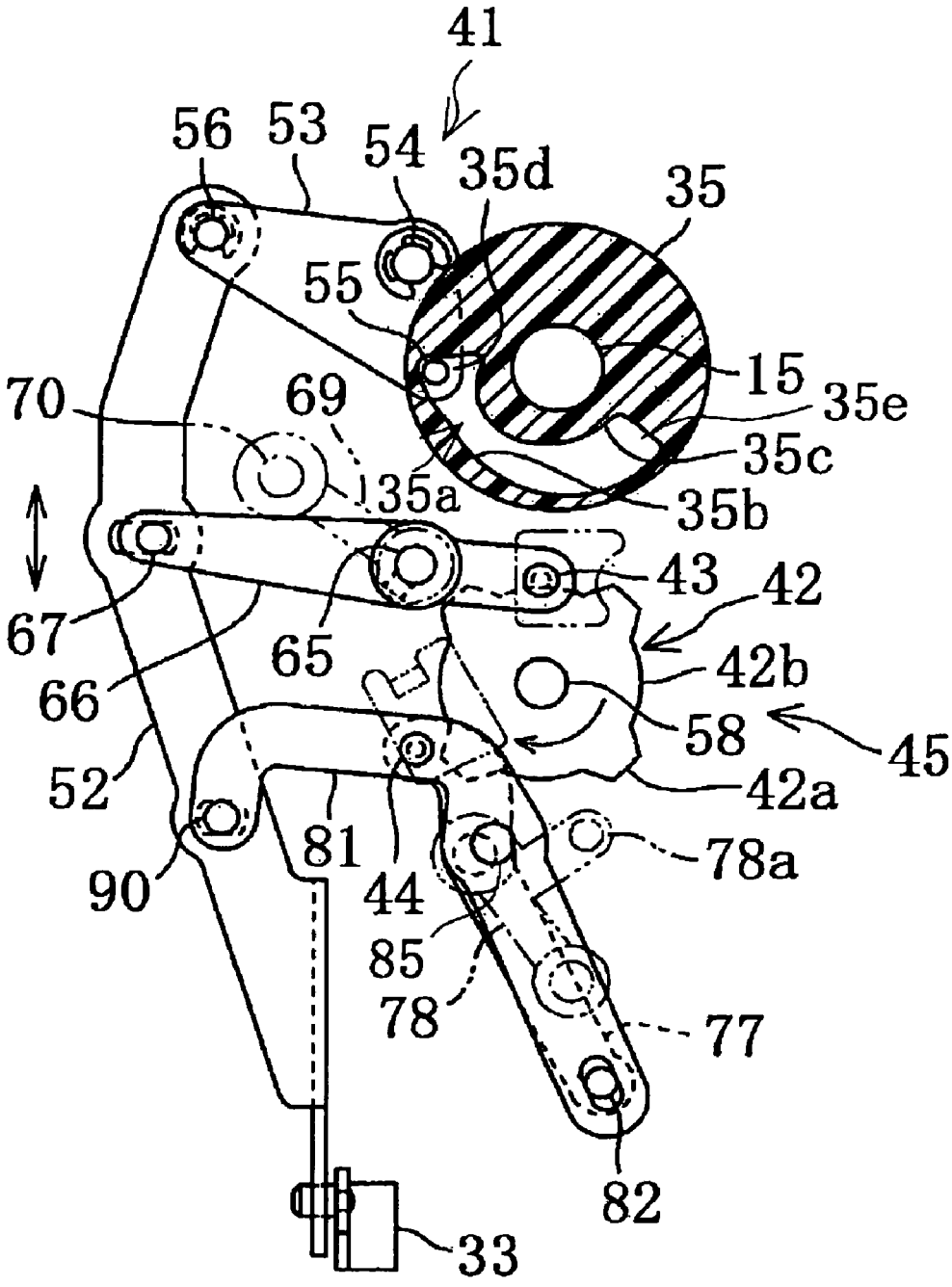
FIG. 15A shows a front view of the feed generating device upon forward cloth feed for a first super pattern.
Figure 15B:
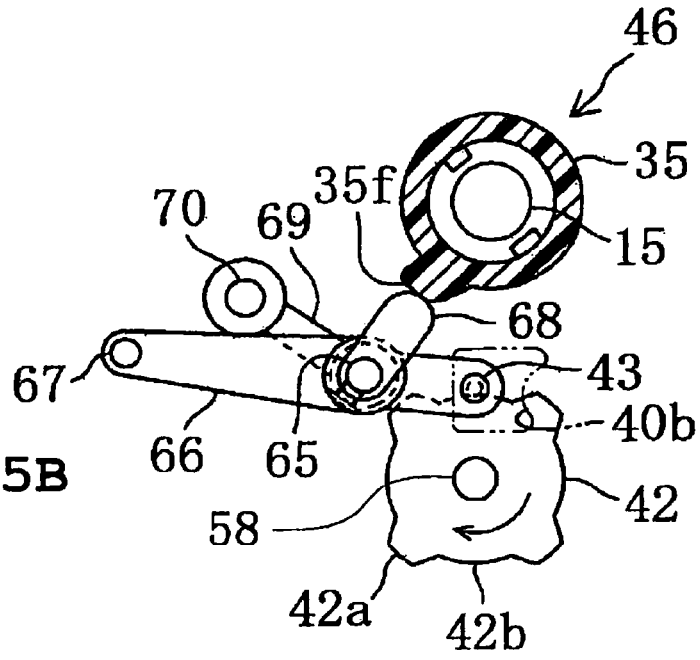
FIG. 15B shows a front view of the first switching mechanism upon forward cloth feed for the first super pattern.
Figure 16A:
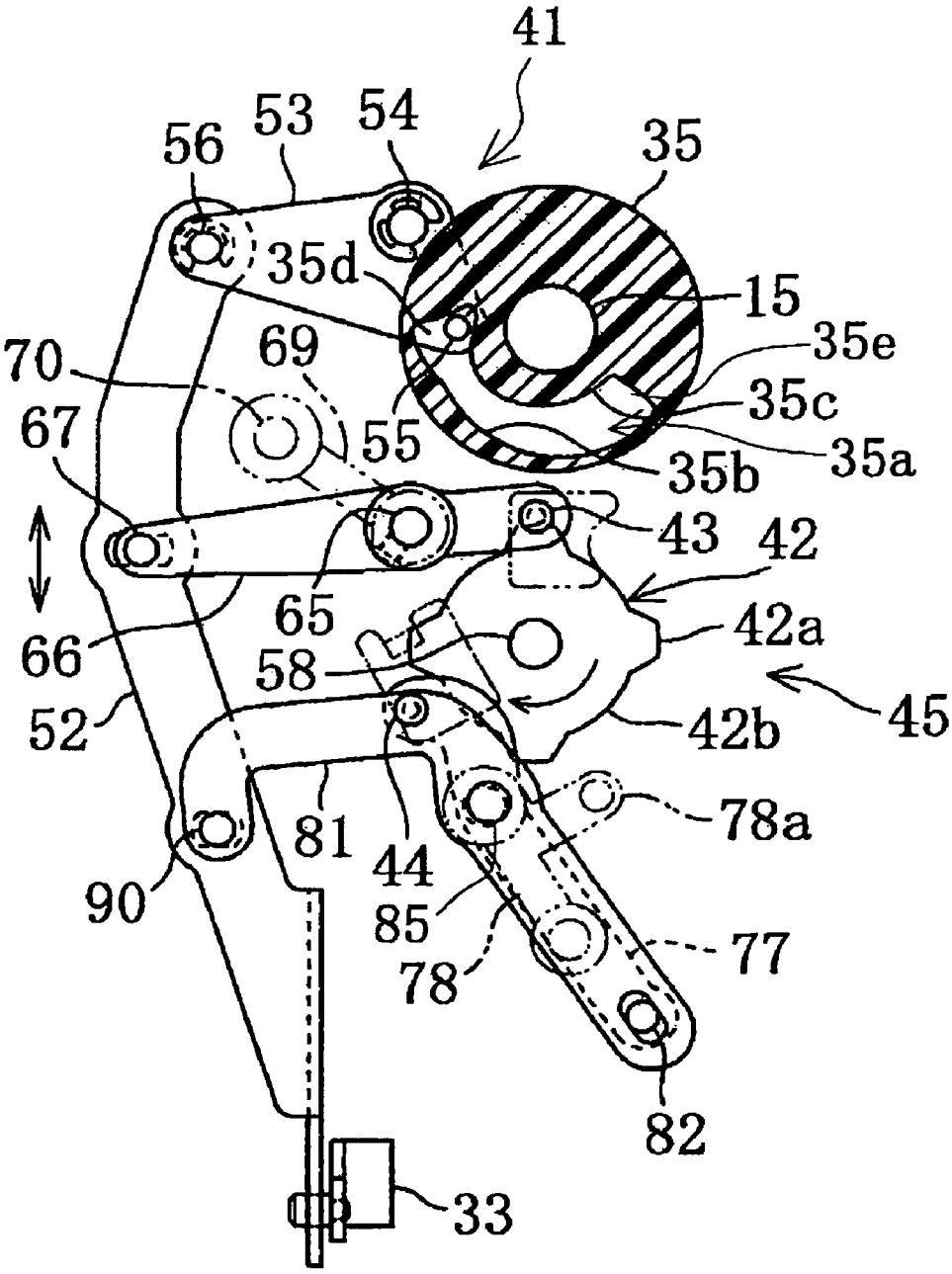
FIG. 16A shows a front view of the feed generating mechanism upon backward cloth feed for the first super pattern.
Figure 16B:
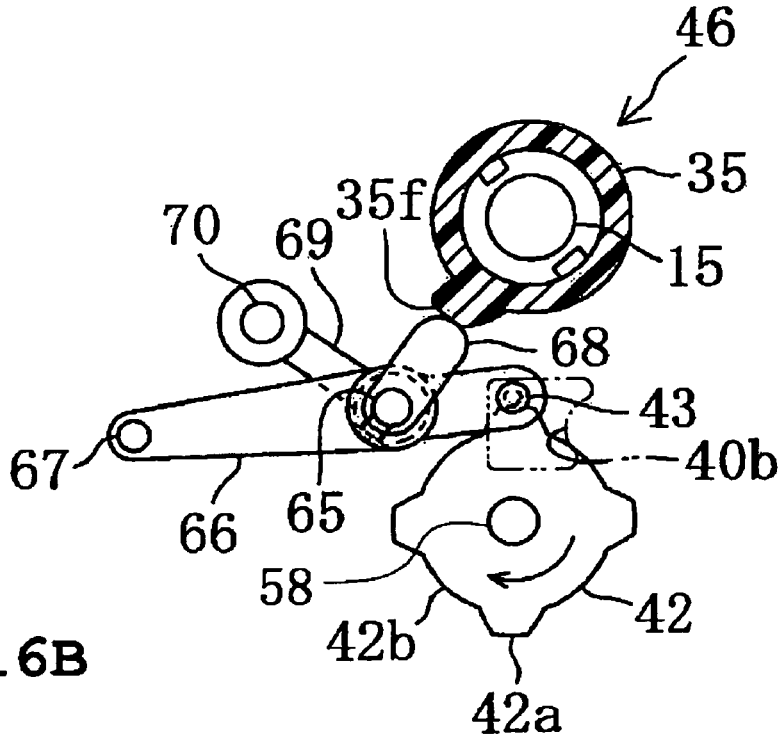
FIG. 16B shows a front view of the first switching mechanism upon backward cloth feed for the first super pattern.

However, when the first super pattern (SS1) is selected by the feed dial 36, as shown in FIGS. 15B and 16B, the first cam contacting lever 68 contacts the first switching cam 35*f* and is pushed downward. Consequently, the first cam detection lever 66 is moved downward in resistance to the spring force of the torsion spring 71 and the first super feed contact 43 contacts the super feed cam 42 from above.

At this point, the rotational center of the first cam detection lever 66 is located by the first lever support 69 and the first contact lever 68. Therefore, when the super feed cam 42 is rotationally driven with the first super feed contact 43 contacting the super feed cam 42, the first super feed contact 43 is vertically moved by the backward cam surfaces 42*a* and the forward cam surfaces 42*b* of the super feed cam 42. Thus, the first cam detection lever 66 swings clockwise or counterclockwise with the link shaft 65 as the rotational center and the feed generating plate 52 is moved vertically via a first super pattern feed generating mechanism 49.

That is, the link pin 67 is fixed on the left end of the first cam detection lever 66. Therefore, the feed generating plate 52 is moved vertically in conjunction with the swing of the first cam detection lever 66, consequently conducting a cyclic forward and backward feed movement of the workpiece cloth. At this point, the utility feed contact 55 is retracted to the retraction area 35*d* and the cloth feed movement for the utility pattern is not generated. That is, the cloth feed movement for the super patterns is not affected by the cloth feed movement for the utility patterns.

Figure 8:
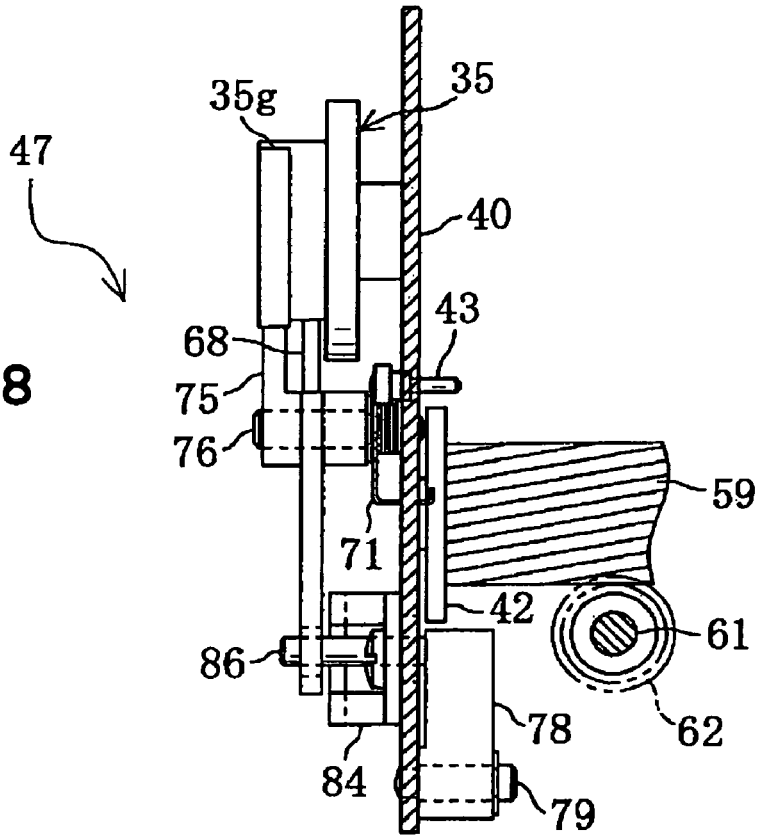
FIG. 8 shows a right side view of the feed generating device.
Figure 9:
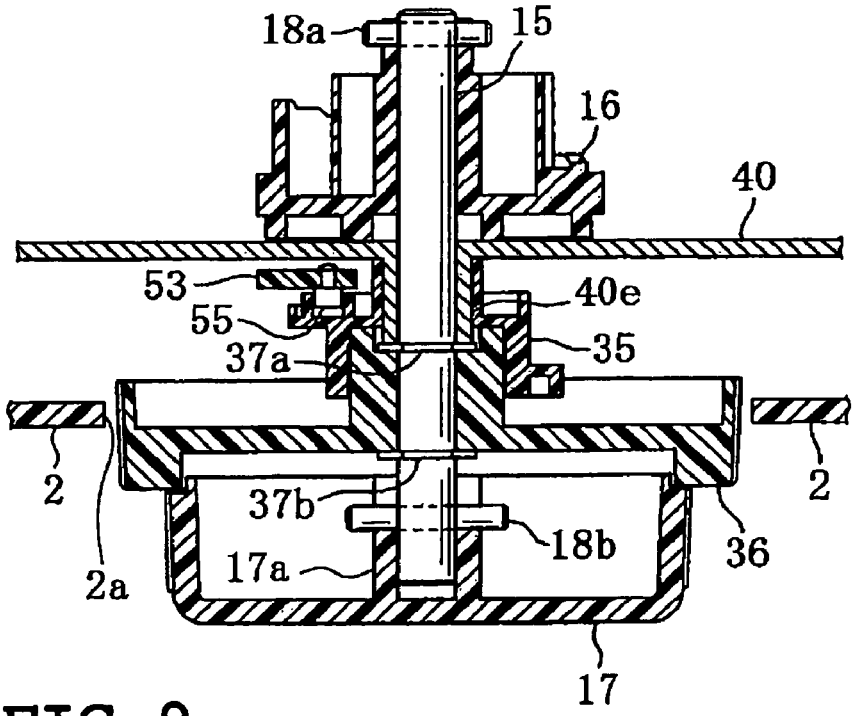
FIG. 9 shows a transverse sectional view taken along line 9-9 in FIG. 5.
Figure 11:
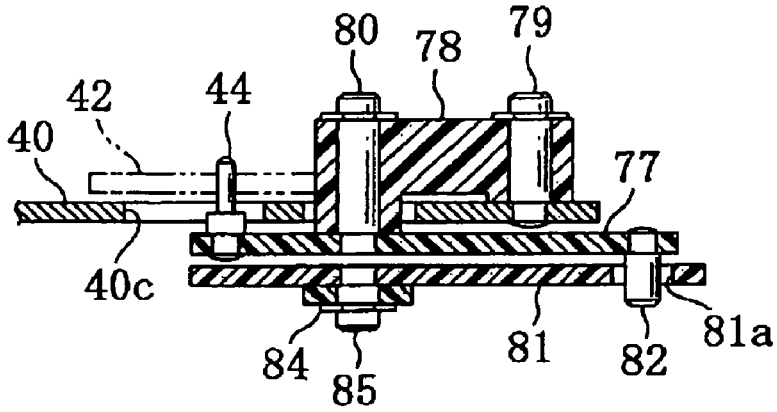
FIG. 11 shows a transverse sectional view taken along line 11-11 in FIG. 5.

On the other hand, the second switching mechanism 47 is constructed as follows. As shown in FIGS. 5, 8 and 11, the support shaft 76 is fixed in the front surface of the base frame 40 immediately below the switch control cam 35. The hook-shaped second cam contacting lever 75 is rotatably supported on the bent portion of the support shaft 76. A second switching cam 35*g* is formed on the front surface of the switch control cam 35, and the upper end of the second cam contacting lever 75 is constructed so as to be capable of contacting the second switching cam 35*g*. The second switching cam 35*g* is located in front of the first switching cam 35*f*. The second cam contacting lever 75 is constructed so as not to contact the first switching cam 35*f*, and the first contact lever 68 is constructed so as not to contact the second switching cam 35*g*.

Also, in the lower portion of the base frame 40, a second cam detecting lever 77 and a second lever support 78 are arranged in the front and the rear of the base frame 40 respectively. The lower end of the second lever support 78 is rotatably supported by the base frame 40 by a support pin 79. The upper end of the second lever support 78 and the upper portion of the second cam detecting lever 77 are linked by a link shaft 80 arranged in the fourth opening 40*d* of the base frame 40. The front end of the second super feed contact 44 extending in the longitudinal direction is fixed on the upper end of the second cam detecting lever 77. The second super feed contact 44 is arranged in the third opening 40*c* of the base frame 40.

Furthermore, immediately in front of the second cam detecting lever 77, a substantially L-shaped feed swinging lever 81 is arranged. A link pin 82 is fixed on the lower end of the second cam detecting lever 77. The link pin 82 is engaged to the engagement hole 81*a* formed in the lower end of the feed swinging lever 81. A lever support 84 extending in the lateral direction is fixed on the lower front surface of the base frame 40 by a fixing screw 83. The lower end of the second cam contacting lever 75 is located in front of the central portion of the lever support 84. An engagement hole 75*a* and a notched hole 84*a* are respectively formed on the lower end of the second cam contacting lever 75 and the central portion of the second lever support 84. The central portion of the feed swinging lever 81 is rotatably supported on the left end of the second lever support 84 by a support pin 85.

A protruding link 78*a* (refer to FIG. 17C) is formed on the right side of the upper portion of the second lever support 78. A link pin 86 is fixed on the front surface of the protruding link 78*a*. The notched hole 84*a* is formed in the central portion of the second lever support 84, and the link pin 86 is engaged to the engagement hole 75*a* of the second cam contacting lever 75 via the notched hole 84*a*.

A helical extension spring 87 has one end in engagement with the curved portion of the second cam contacting lever 75. The other end of the helical extension spring 87 is hooked on a cut-out protrusion 40*g* formed on the base frame 40. Therefore, the second cam contacting lever 75 having the support shaft 76 as the rotational center is urged clockwise by the spring force of the helical extension spring 87. Thus, the upper end of the second cam detecting lever 77 is urged toward the left via the link pin 86 and the second lever support 78.

At this point, in case a normal cloth feed amount (cloth feed amount: 1, 2, 3, 4) is selected (refer to FIGS. 5, 13C and 14C) or the first super pattern (SS1) is selected (FIGS. 15C and 16C) by the feed dial 36, the upper end of the second cam contacting lever 75 does not contact the second switching cam 35*g*. Therefore, since the upper portion of the second contacting lever 77 is urged toward the left, the second super feed contact 44 does not contact the super feed cam 42.

Figure 17A:
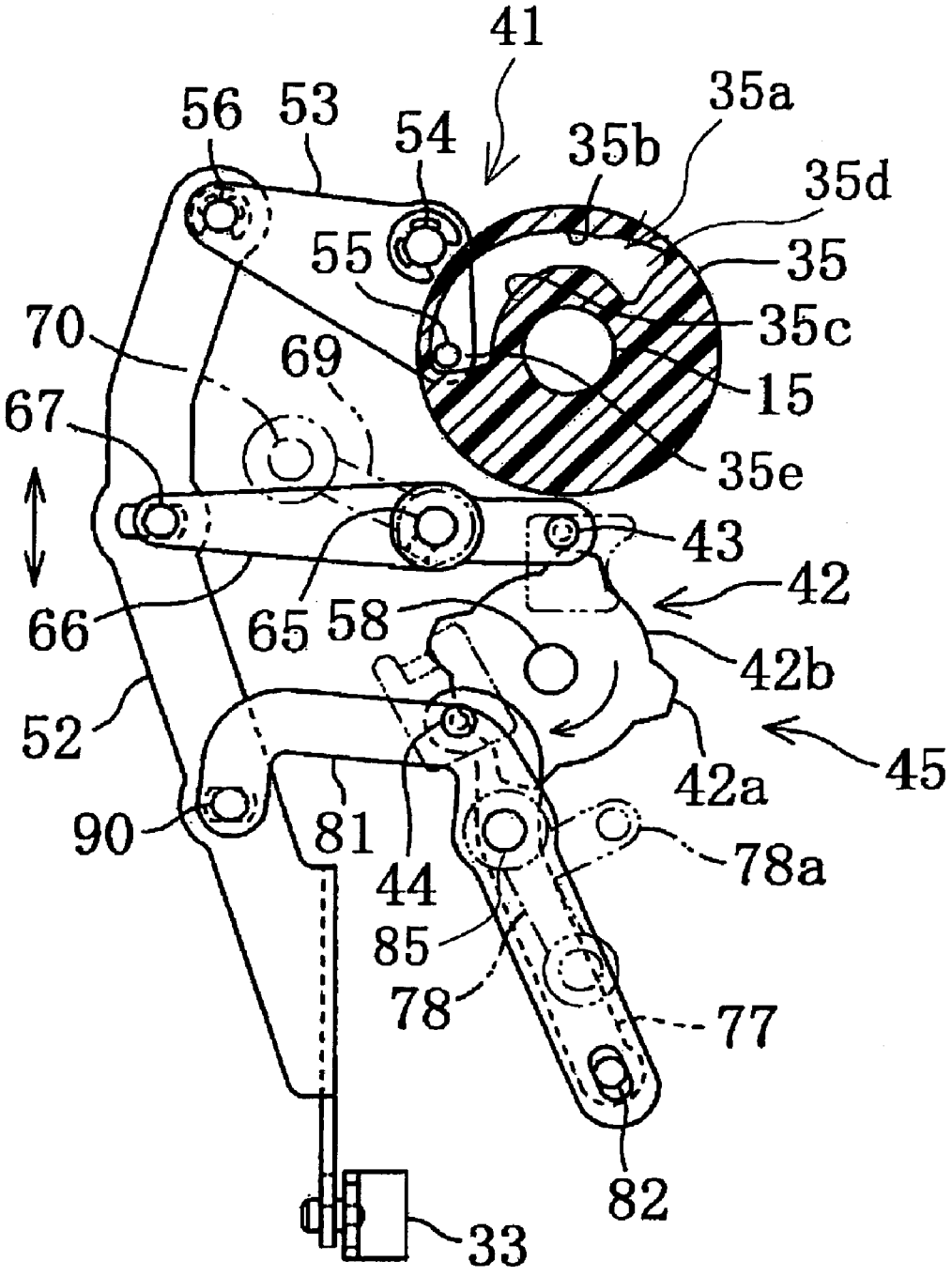
FIG. 17A shows a front view of the feed generating device upon forward cloth feed for a second super pattern.
Figure 17B:
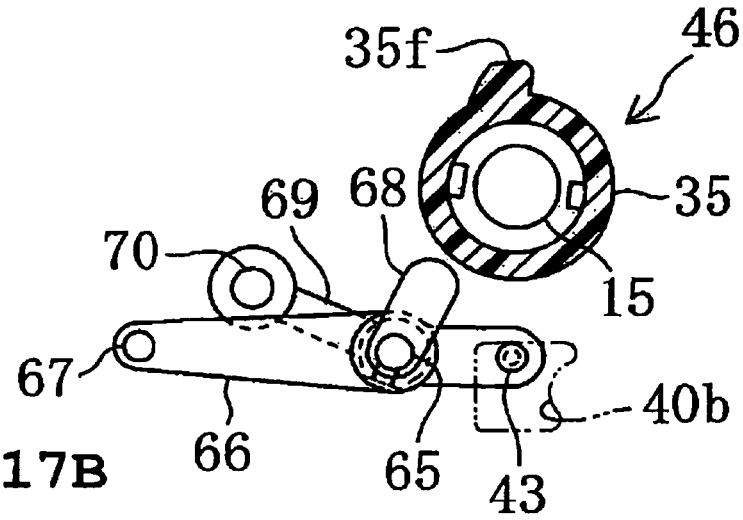
FIG. 17B shows a front view of the first switching mechanism upon forward cloth feed for the second super pattern.
Figure 17C:
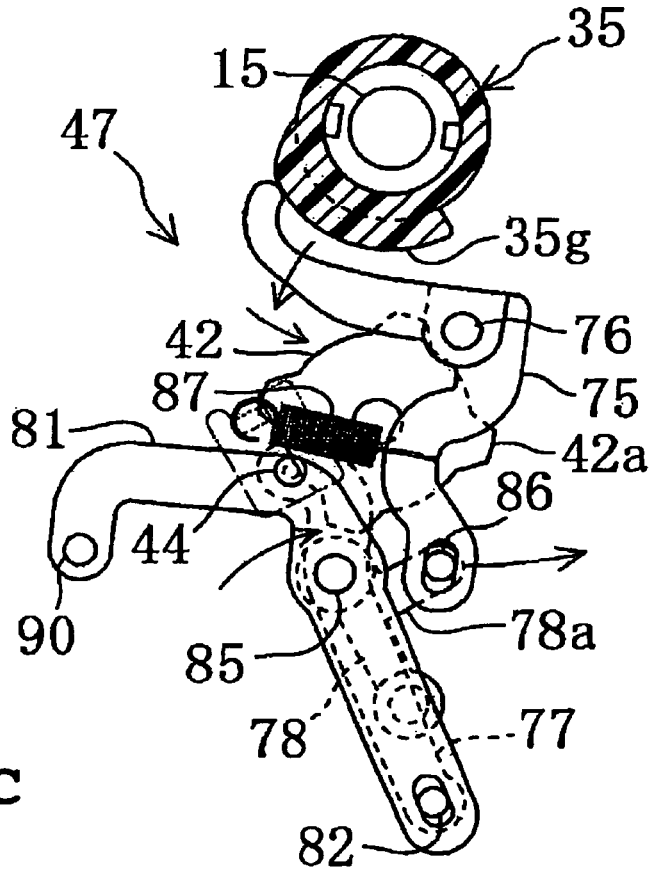
FIG. 17C shows a front view of the second switching mechanism upon forward cloth feed for the second super pattern.
Figure 18A:
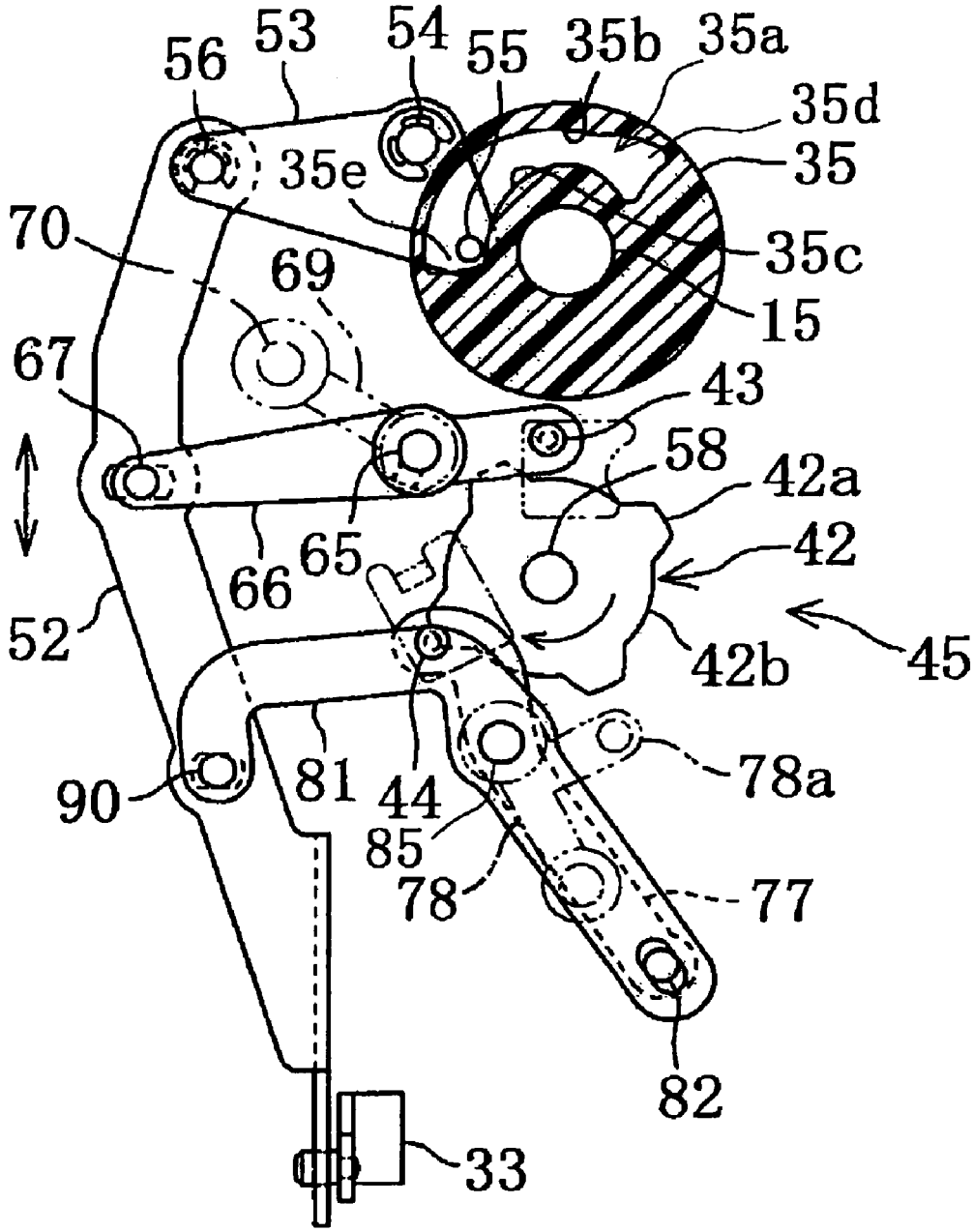
FIG. 18A shows a front view of the feed generating mechanism upon backward cloth feed for the second super pattern.
Figure 18B:
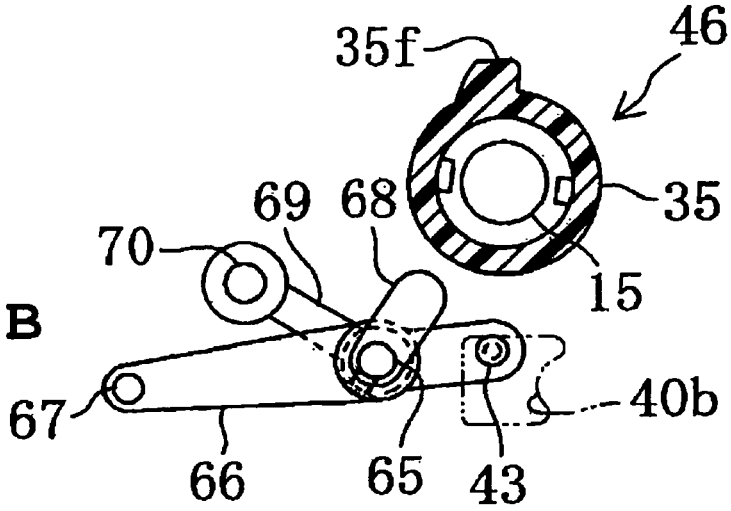
FIG. 18B shows a front view of the first switching mechanism upon backward cloth feed for the first super pattern.
Figure 18C:
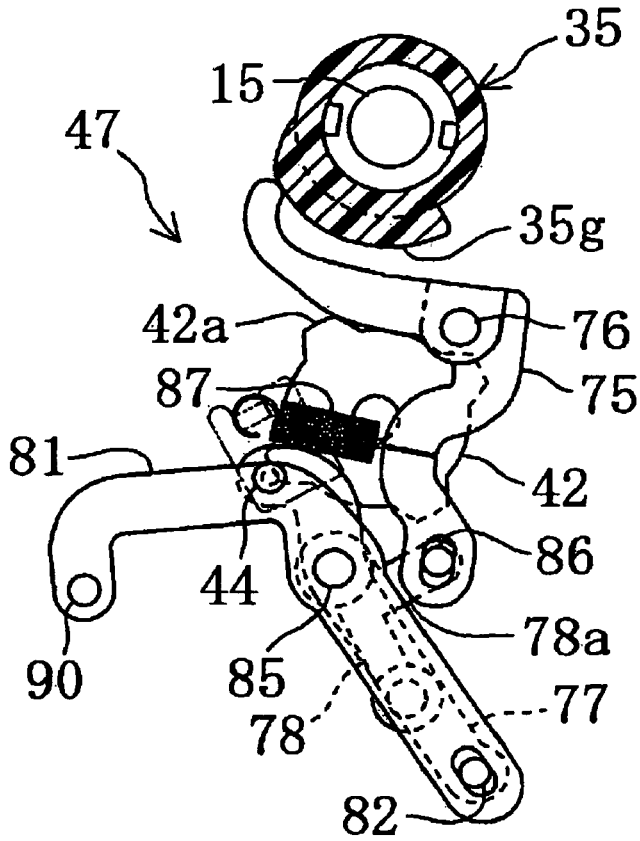
FIG. 18C shows a front view of the second switching mechanism upon backward cloth feed for the second super pattern.

However, when the second pattern (SS2) is selected by the feed dial 36, as shown in FIGS. 17C and 18C, the upper end of the second cam contacting lever 75 contacts the second switch cam 35*g* and the second cam contacting lever 75 rotates counterclockwise in resistance to the spring force of the helical extension spring 87. Therefore, since the upper end of the second cam detecting lever 77 moves to the right by the rightward rotation of the upper end of the second lever support 78, the second super feed contact 44 contacts the super feed cam 42 from the left side.

At this point, the rotational center of the second cam detecting lever 77 is positioned by the second lever support 78. Therefore, when the super feed cam 42 is rotated with the second super feed contact 44 contacting the super feed cam 42 from the left side, the second super feed contact 44 is reciprocated in the lateral direction by the backward cam surfaces 42*a* and forward cam surfaces 42*b* of the super feed cam 42 with the link shaft 80 as the rotational center. Thus, the feed swinging lever 81 swings clockwise or counterclockwise with the support pin 85 as the center and the feed generating plate 52 is moved vertically via a second super pattern feed generating mechanism 50.

That is, a link pin 90 is fixed on the left end of the feed swinging lever 81. The link pin 90 is engaged with a second engagement hole 52*b* formed on the feed generating plate 52. Therefore, the feed generating plate 52 is moved vertically in conjunction with the swing of the feed swinging lever 81, consequently conducting a cyclic forward and backward feed movement of the workpiece cloth. At this point, since the utility feed contact 55 is retracted to the lower retraction area 35*e*, the cloth feed movement for the utility pattern does not affect the cloth feed movement for the super pattern. The super feed generating mechanism 48 comprises the first and the second super pattern feed generating mechanisms 49 and 50.

Figure 12:
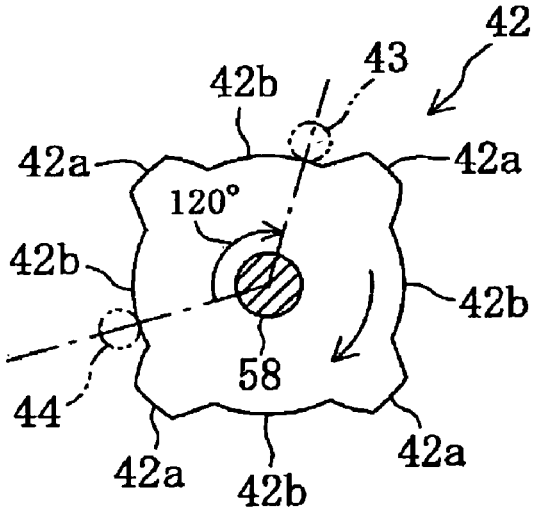
FIG. 12 shows a front view of a super feed cam.

The swing phases of the first and the second super feed contacts 43 and 44 with respect to the super feed cam 42 are described hereinafter. As shown in FIG. 12, there is approximately a 120° phase difference between the swing phases of the first super feed contact 43 and the second super feed contact 44 with respect to the rotational center of the super feed cam 42. That is, there is a 30° lag corresponding to 1 stitch from a phase difference of 90° which corresponds to 3 stitches. Therefore, the swing phase of the second super feed contact 44 is 30° displaced from the swing phase of the first super feed contact 43. Thus, as opposed to a forward, forward, backward forward, forward, backward . . . sequence of cloth feed movement generated upon swinging of the first super feed contact 43, a cloth feed movement of forward, backward, forward, forward, backward, forward . . . is generated upon swinging of the second super feed contact 44. That is, the generation of backward feed by the second super feed contact 44 is 1 stitch ahead as compared to the generation of backward feed of the first super feed contact 43.

Figure 14A:
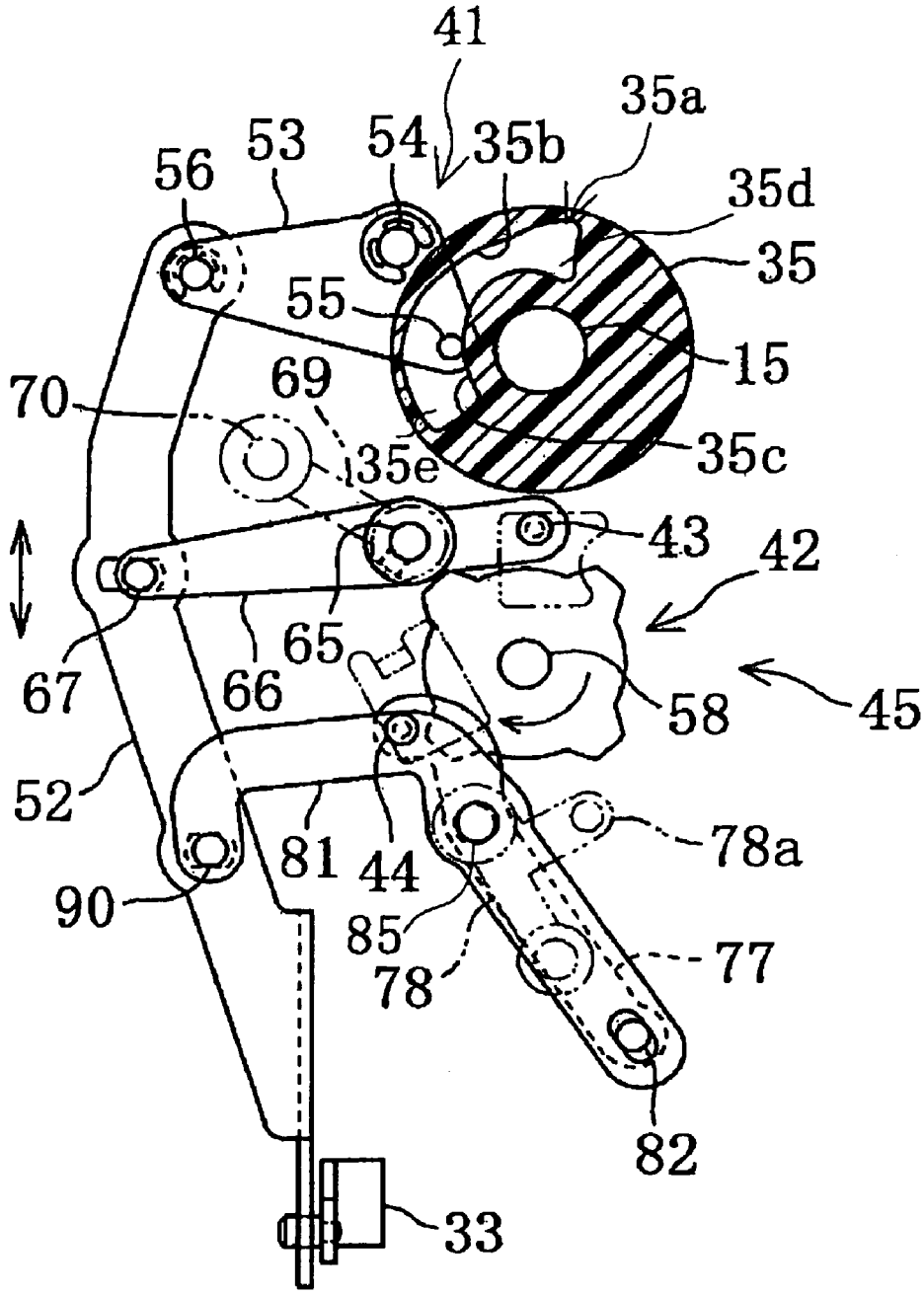
FIG. 14A shows a front view of a feed generating mechanism upon backward cloth feed for the utility pattern.

Next, the operation and effect of the feed generating device 13 having the above construction is described hereinafter. In case of sewing a utility pattern, first, a desired utility pattern is selected by the pattern selection dial 17. Then, a needle swinging contact is moved by the needle swinging contact moving mechanism so as to be paired with the predetermined needle swinging cam, whereupon the needle swinging movement by the needle swinging mechanism becomes executable. Also, when the feed amount for the utility pattern is set by the feed dial 36, the switch control cam 35 is integrally rotated with the feed dial 36. Thus, as shown in FIG. 13A, the contact location of the utility feed contact 55 with respect to the normal feed cam surface 35*b* of switch control cam 35 is changed. Consequently, the utility feed lever 53 is swung so as to change the height of the feed generating plate 52 thereby changing the forward feed amount. Also, upon back-tacking, as shown in FIG. 14A, the utility contact 55 contacts the reverse feed cam surface 35*c* and the switch is made to the reverse feed.

Figure 13B:
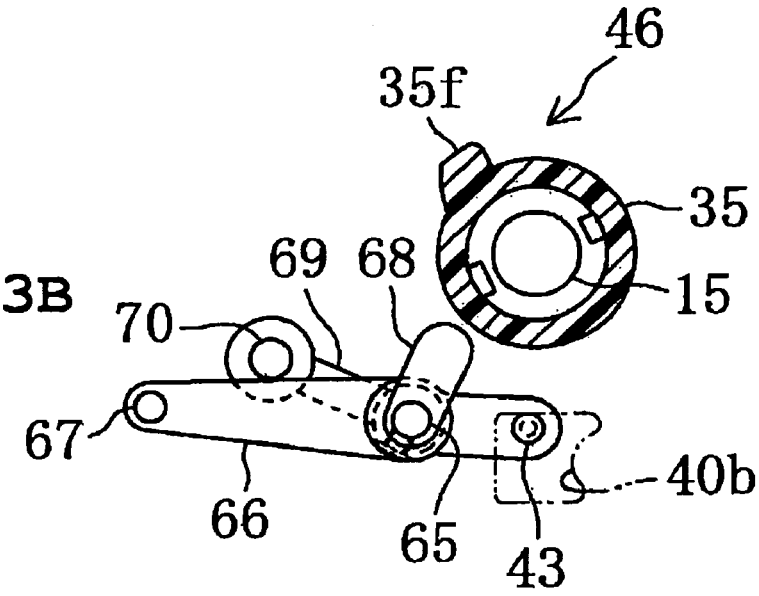
FIG. 13B shows a front view of a first switching mechanism upon forward cloth feed for the utility pattern.
Figure 13C:
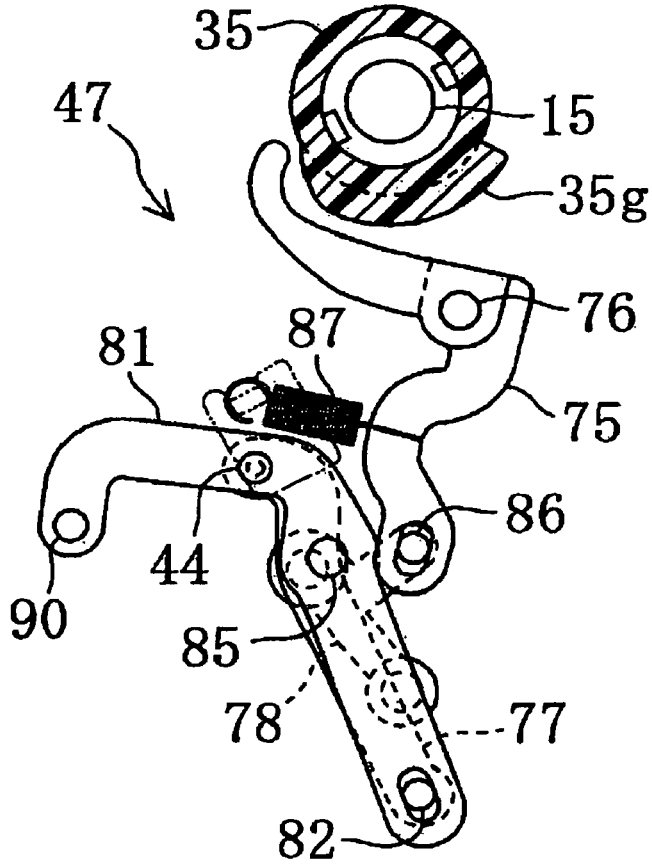
FIG. 13C shows a front view of a second switching mechanism upon forward cloth feed for the utility pattern.
Figure 14B:
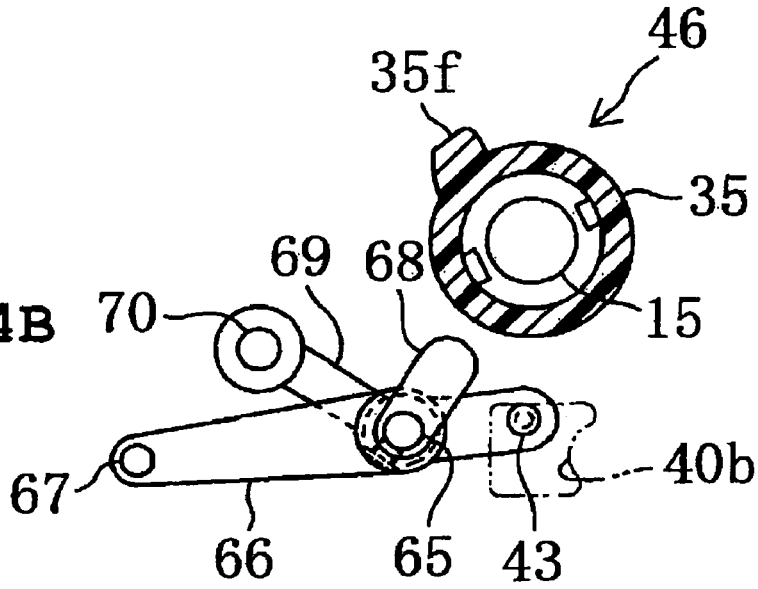
FIG. 14B shows a front view of the first switching mechanism upon backward cloth feed for the utility pattern.
Figure 14C:
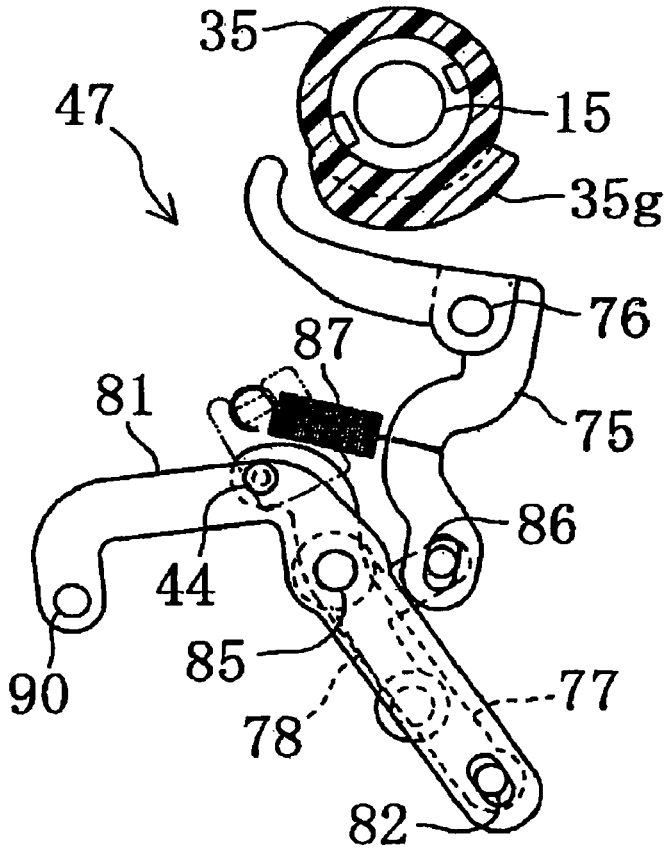
FIG. 14C shows a front view of the second switching mechanism upon backward cloth feed for the utility pattern.

In case the cloth feed amount for the utility pattern is thus selected by the feed dial 36, as shown in FIGS. 13B and 14B, the first cam contacting lever 68 does not contact the first switching cam 35*f* and likewise, as shown in FIGS. 13C and 14C, the second cam contacting lever 75 does not contact the second switching cam 35*g*. Therefore, the cloth feed movement for the super pattern does not affect the cloth feed movement for the utility pattern.

Also, in case of sewing the first super pattern, the "SS1" mark is to be matched with the selection mark 3*a* by rotating the feed dial 36. Then, as shown in FIGS. 15A, 15B, 16A and 16B, the first super feed contact 43 contacts the super feed cam 42 from above. Consequently, the first cam detection lever 66 is swung with the link shaft 65 as the rotational center so as to vertically move the feed generating plate 52. That is, as shown in FIG. 15A, when the first super feed contact 43 contacts the forward cam surface 42*b* of the super feed cam 42, the forward feed movement is performed; and likewise, as shown in FIG. 16A, when the first feed contact 43 contacts the backward cam surface 42*a* of the super feed cam 42, the backward feed movement is performed.

Figure 15C:
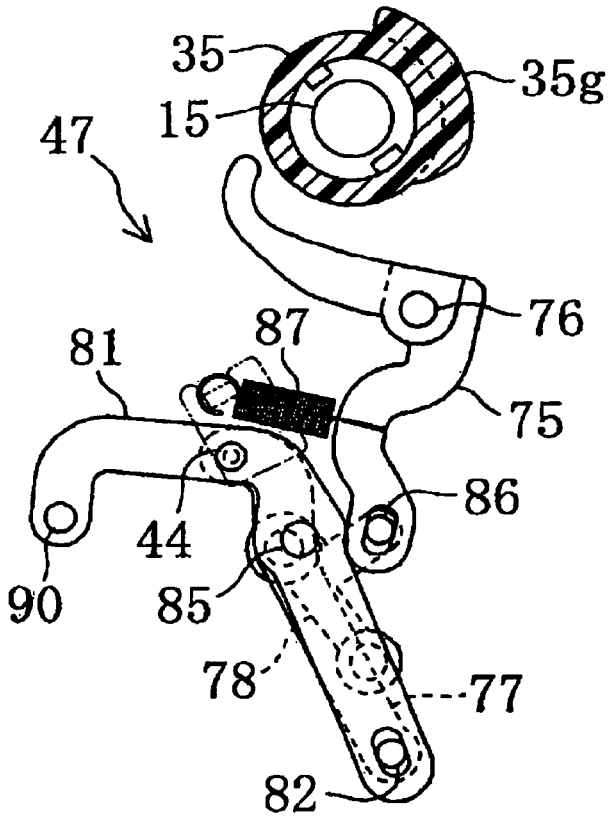
FIG. 15C shows a front view of the second switching mechanism upon forward cloth feed for the first super pattern.
Figure 16C:
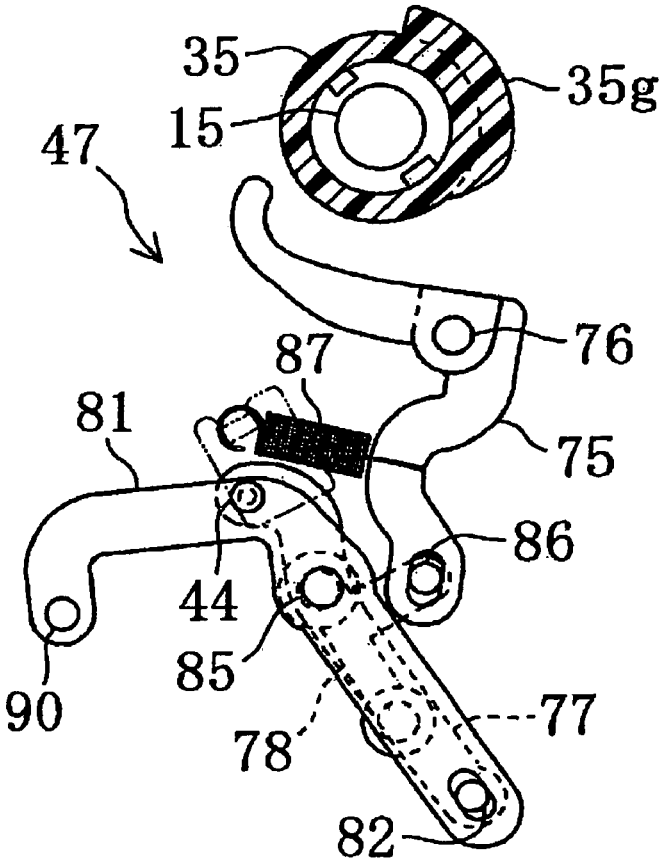
FIG. 16C shows a front view of the second switching mechanism upon backward cloth feed for the first super pattern.

At this point, as shown in FIGS. 15A and 16A, the utility feed contact 55 is retracted to the retraction area 35*d* of the utility feed cam 35*a*. Also, as shown in FIGS. 15C and 16C, the second cam contacting lever 75 does not contact the second switching cam 35*g*. Therefore, the cloth feed movement for the utility pattern and the cloth feed movement for the second super pattern does not affect the cloth feed movement for the first super pattern.

On the other hand, in case of sewing the second super pattern, the "SS2" mark is to be matched with the selection mark 3*a* by rotating the feed dial 36. Then, as shown in FIGS. 17A, 17C, 18A and 18C, the second super feed contact 44 contacts the super feed cam 42 from the left side. Consequently, the feed swinging lever 81 swings with the support pin 85 as the rotational center and the feed generating plate 52 is vertically moved. That is, as shown in FIGS. 17A and 17C, when the second super feed contact 44 contacts the forward cam surface 42*b* of the super feed cam 42, the forward feed movement is performed; and likewise, as shown in FIGS. 18A and 18C, when the second feed contact 44 contacts the backward cam surface 42*a* of the super feed cam 42, the backward feed movement is performed.

At this point, as shown in FIGS. 17A and 18A, the utility feed contact 55 is retracted in the retraction area 35*e* of the utility feed cam 35*a*. Also, as shown in FIGS. 17B and 18B, the first cam contacting lever 68 does not contact the first switching cam 35*f*. Therefore, the cloth feed movement for the utility pattern and the cloth feed movement for the first super pattern do not affect the cloth feed movement for the second super pattern.

As described earlier, there is a 30° difference between the swing phase of the first super feed contact 43 and the second super feed contact 44 and the generation of the backward feed by the second super feed contact 44 leads the generation of the backward feed by the first super feed contact 43 by 1 stitch.

Therefore, in case the utility pattern indicated by number "6" in FIG. 19 is selected by the pattern selection dial 17 for example and the first super feed contact 43 is enabled by the feed dial 36, the cloth feed is conducted in the forward, forward, backward forward, forward, backward . . . sequence. Hence, sewing of the first super pattern indicated by number "28" in FIG. 19 becomes possible. As opposed to this, in case the second super pattern is selected by the feed dial 36 and second super feed contact 44 is enabled, the cloth feed is performed in the forward, backward, forward, forward, backward, forward . . . sequence. Hence, sewing of the second super pattern indicated by the number "18" in FIG. 19 becomes possible.

Thus, in the present embodiment, the first and the second super feed contacts 43 and 44 contacting a single super feed cam 42 in contact locations of different swing phases have been provided. The first and the second super feed contacts 43 and 44 are constructed to selectively contact the super feed cam 42 by the contact switching mechanism 45. Therefore, sewing of a plurality of super patterns including variably timed backward feeds within a sequence of forward feeds becomes possible by only providing a single super feed cam 42.

Also, since the feed releasing mechanism for conventional super feed contacts is no longer required, size and weight reduction of the feed generating device 13 can be achieved.

Furthermore, the first and second selection operators 36*a* and 36*b* for operating the contact switching mechanism 45 have been constructed integrally with the feed dial 36 that sets the cloth feed amount for the utility patterns; therefore, the number of parts can be reduced.

Also, since the first and the second super patterns can be selected by rotating the feed dial 36 beyond the cloth feed setter 36*c* which is the setting range for cloth feed amount, there will not be any confusion between the setting operation of cloth feed amount for the utility patterns and the selection operation for the super patterns, with the result of improving the operability.

Moreover, since the switching movement for contacting the super feed contact to the super feed cam 42 by the first and second selection operators 36*a* and 36*b* does not require a conventional feed releasing mechanism, the force required for operating the first and second selection operators 36*a* and 36*b* can be reduced.

Yet, furthermore, since the first and second selection operators 36*a* and 36*b* have been arranged coaxially with the pattern selection dial 17, practical and compact arrangement of the switching operators 36*b*, 36*b* and the pattern selection dial 17 can be achieved.

Also, the utility feed cam 35*a* for utility patterns and the first and the second switching cams 35*f* and 35*g* that selectively render the first and the second super feed contacts 43 and 44 to contact the super feed cam 42 have been integrally provided in a single switch control cam 35; therefore, number of parts can be reduced.

FIGS. 20 to 35 show a second embodiment of the present invention, and only the difference of the second embodiment from the first embodiment will be explained hereinafter. Identical or similar parts in the second embodiment are labeled by the same reference symbols as those in the first embodiment. The feed generating device of a sewing machine according to the present embodiment is characterized by providing a single super feed contact capable of contacting one (a single) super feed cam in a plurality of contact locations of different swing phases by switching the location of the super feed contact so as to enable the sewing of a plurality of super patterns.

Figure 21:
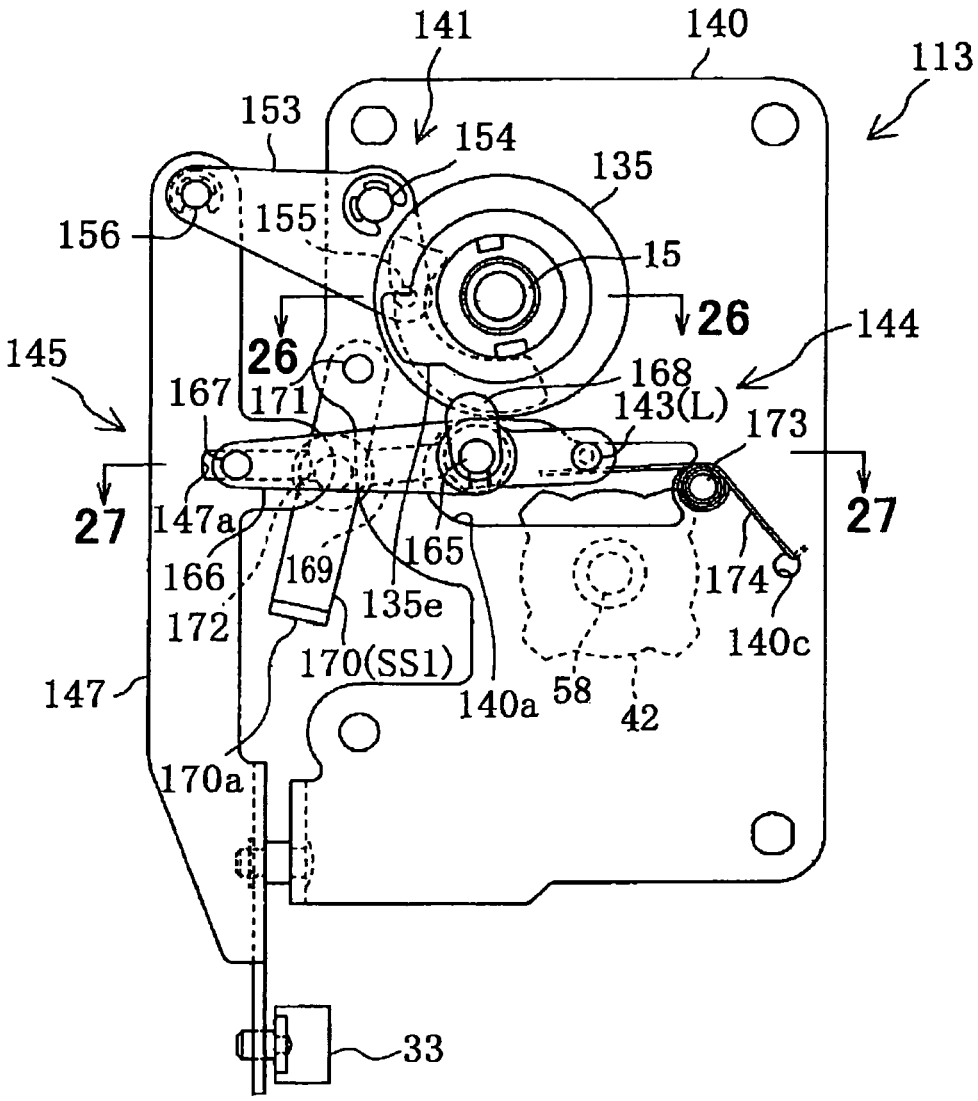
FIG. 21 shows a front view of the feed generating device when a switch operation lever is in a first super pattern location.

More concretely, as shown in FIG. 21, the feed generating device 113 is provided with a substantially oblong base frame 140; a utility feed generating mechanism 141 provided on the base frame 140; and the super feed cam 42. The feed generating device 113 is further provided with a super feed contact 143; a location switching mechanism 144 that switches the location of the super feed contact 143 such that a swing phase of the super feed contact 143 is displaced for a predetermined amount; and a super feed generating mechanism 145; and the like.

The base frame 140 is arranged in the vertical direction inside the pillar 2, with a plurality of portions thereof fixed to the sewing machine frame. In the central portion of the height direction of the base frame 140, an oblong opening 140*a* is formed.

Figure 26:
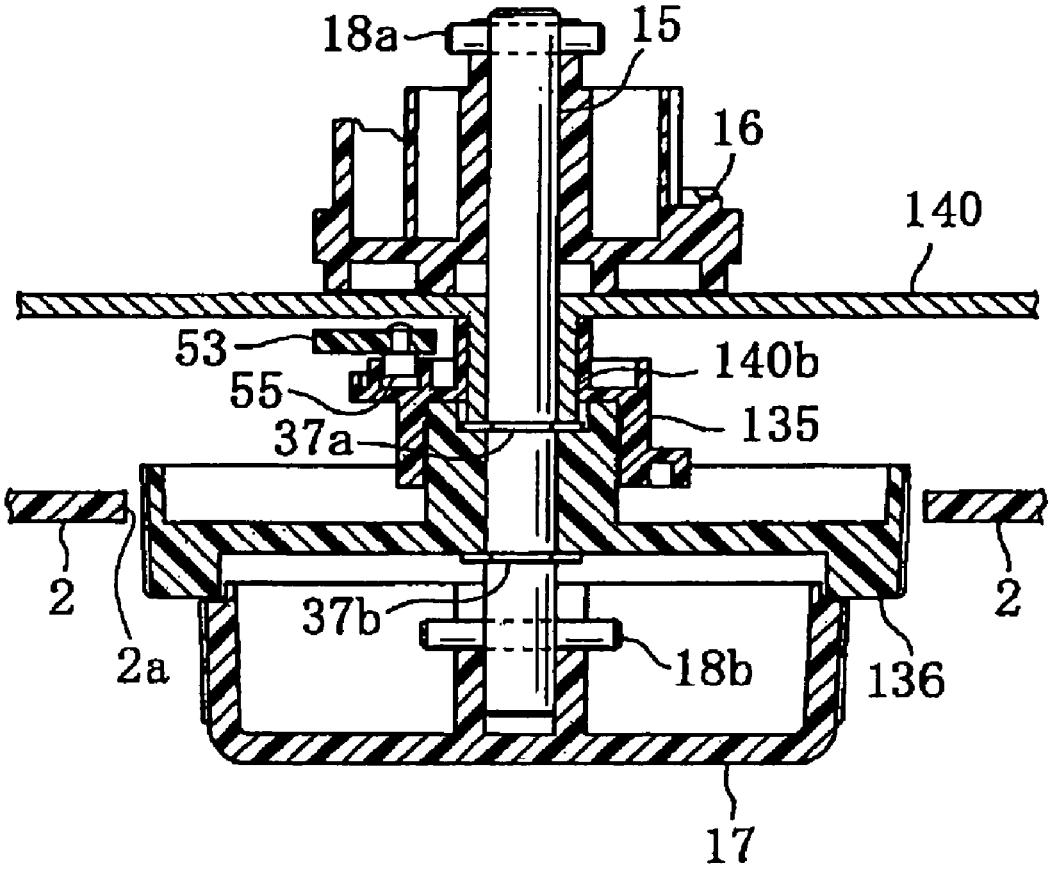
FIG. 26 is a view similar to FIG. 9.

Also, as shown in FIG. 26, a cylindrical support 140*b* is formed on the upper front surface of the base frame 140. On the support 140*b* are integrally provided the pattern selection cam 16, the pattern selection dial 17, a switch control cam 135 and a feed dial 136.

Figure 25:
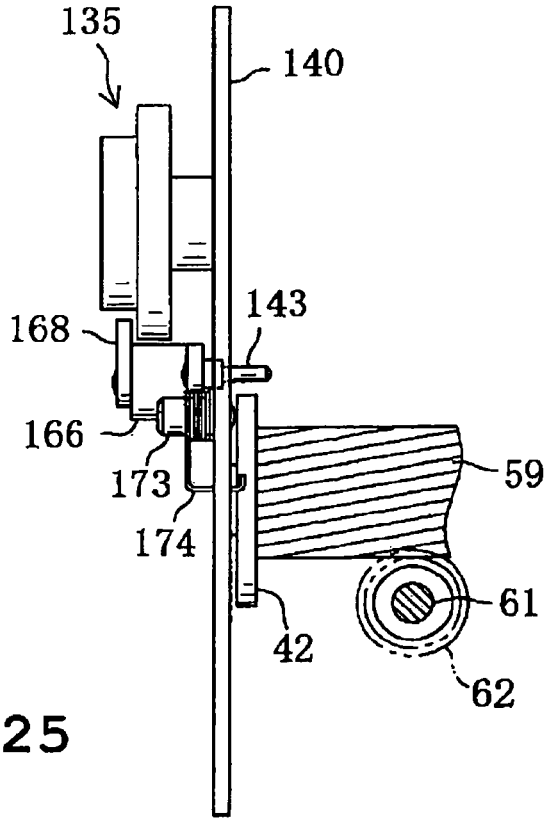
FIG. 25 is a view similar to FIG. 8.
Figure 27:
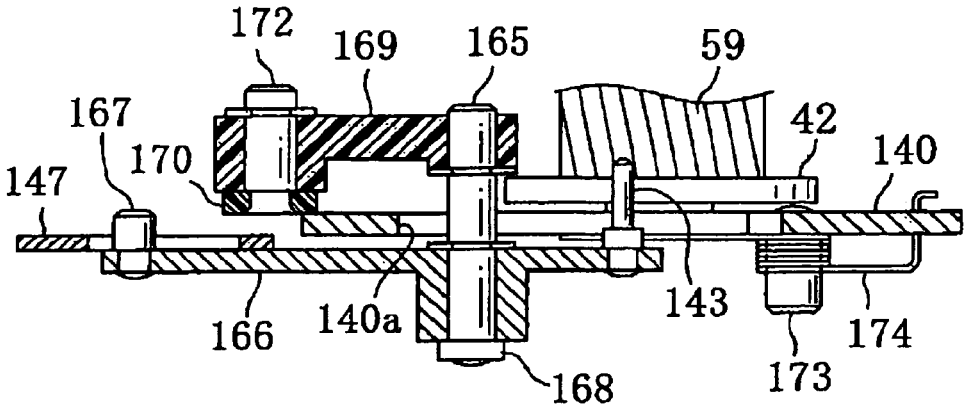
FIG. 27 is a view similar to FIG. 10.

The pattern selection cam 16 has the same construction as in the first embodiment, and the pattern selection dial 17 also has the same construction as in the first embodiment. Furthermore, the feed dial 136 has the same construction as indicated in the first embodiment except for the provision of a common selection operator for selecting the first and the second super patterns (as shown in the selection operator with reference character 136*a* in FIG. 20). On the other hand, as described thereinafter, the construction of the switch control cam 135 is slightly different from the construction of the switch control cam 35 in the first embodiment. Also, as shown in FIGS. 21, 25 and 27, in the rear side of the vertical center of the base frame 140, a super feed cam 42 is rotatably supported via the shaft 58. The super feed cam 42 has the same construction as in the first embodiment wherein the rotation of the main shaft 10 is conveyed via the timing belt 60, worm gear 62 and the worm wheel 59.

Figure 22:
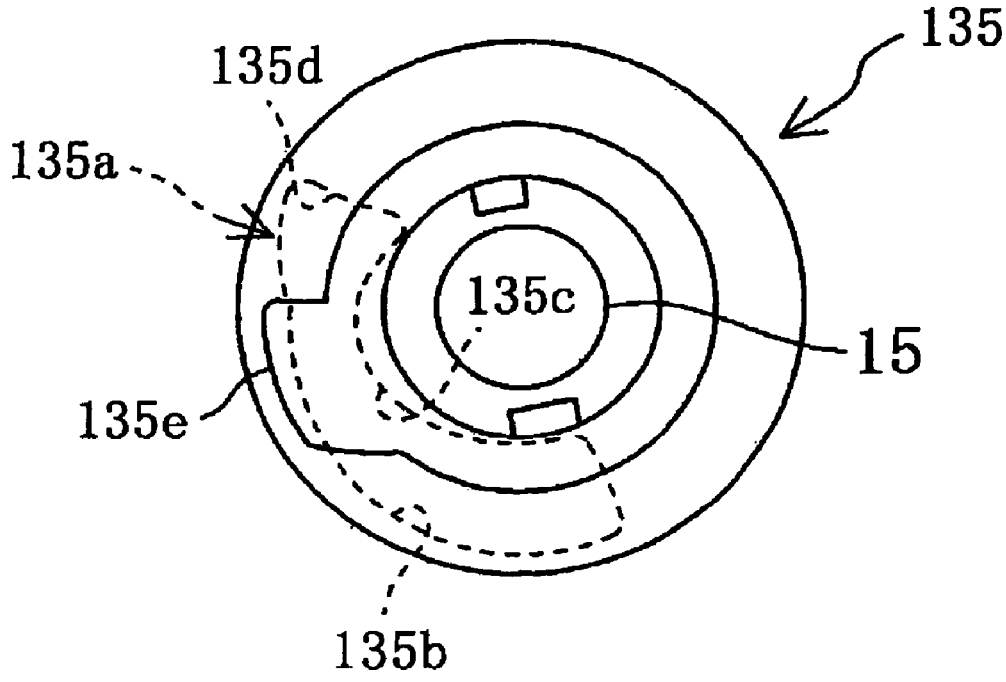
FIG. 22 is a view similar to FIG. 6.
Figure 29A:
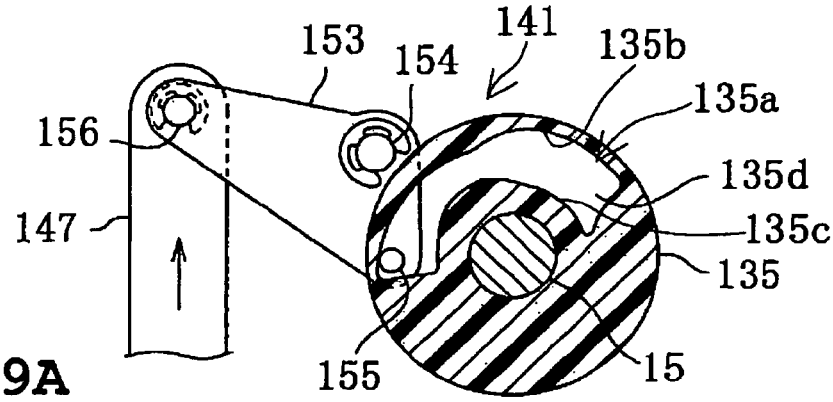
FIG. 29A is a front view of a utility feed generating mechanism upon forward cloth feed for the utility pattern.

Next a utility feed generating mechanism 141 is described. As shown in FIGS. 22 and 29A, a utility feed cam 135*a* forming a recess curved along the outer circumference of the switch control cam 135 is provided on the rear surface of the switch control cam 135. A normal feed cam surface 135*b* for forward feed and a reverse feed cam surface 135*c* for backward feed are respectively formed on the radially opposed inner surfaces of the utility feed cam 135*a*. Also, a retraction area 135*d* is formed on one circumferential end of the utility feed cam 135*a*. On the other hand, a switching cam section 135*e* of a protruding form is formed on the front surface of the switch control cam 135.

A triangular utility feed lever 153 is rotatably supported via a pin 154 in the vicinity of the switch control cam 135 in the left portion of the base frame 140. The right end of the utility feed lever 153 is located in between the switch control cam 135 and the base frame 140; and a utility feed contact 155 approaching the utility feed cam 135*a*is fixed on the front surface of the right end of the utility feed lever 153. Also, the upper end of the feed generating plate 147 is rotatably linked to the left end of the utility feed lever 153 by a link pin 156. The feed generating plate 147 is a member elongated in the vertical direction elastically energized permanently in the upward direction by a helical extension spring 146 (refer to FIG. 24). Thus the utility feed contact 155 normally contacts the normal feed cam surface 135*b*.

When the feed dial 36 is rotationally operated and the switch control cam 135 is rotated together with the feed dial 36, the contact location of the utility feed contact 155 with respect to the normal feed cam surface 135*b* is changed. Then, the utility feed lever 153 is rotated clockwise or counterclockwise so that the height of the feed generating plate 147 and the forward feed amount is in turn changed.

On forming a back-tack upon completion of sewing, the feed generating plate 147 is forcibly lowered in resistance to the spring force of the helical extension spring 146. Hence, the utility feed contact 155 contacts the reverse feed cam surface 135*c*. Thus, back-tacking is enabled by switching to the backward feed. On generating the cloth feed for the super patterns explained thereinafter, the utility feed contact 155 is retracted to the retraction area 135*d* so as not to contact the normal feed cam surface 135*b* or the reverse feed cam surface 135*c*.

Next, the location switching mechanism 144 is described hereinafter. The location switching mechanism 144 switches the location of the super feed contact 143 so that the super feed contact 143 contacts the super feed cam 42 in either one of the two contact locations of different swing phases with respect to the super feed cam 42.

Concretely, as shown in FIGS. 21 and 27, a link shaft 165 extending in the longitudinal direction and the super feed contact 143 are arranged in the opening 140*a* of the base frame 140. The super feed contact 143 is located above the super feed cam 42. A cam detection lever 166 extending in the lateral direction is rotatably supported near the center thereof by the link shaft 165 in the front side of the base frame 140. The front end of the first super contact 143 is fixed to the right end of the cam detection lever 166, and a link pin 167 is fixed to the left end of the cam detection lever 166. The link pin 167 is engaged to an engagement hole 147*a* of the feed generating plate 147.

The lower end of a cam contacting lever 168 of an oval form is fixed to the front end of the link shaft 165. Also, the right end of a lever support 169 is fixed in the rear portion of the link shaft 165, forming a predetermined angle (approximately 90°, for example) with the cam contacting lever 168. A switch operation lever 170 extending in the vertical direction has an upper end which is located below the utility lever 153 and rotatably supported on the rear surface of the base frame 140. The switch operation lever 70 corresponds to a switch operator.

Figure 20:
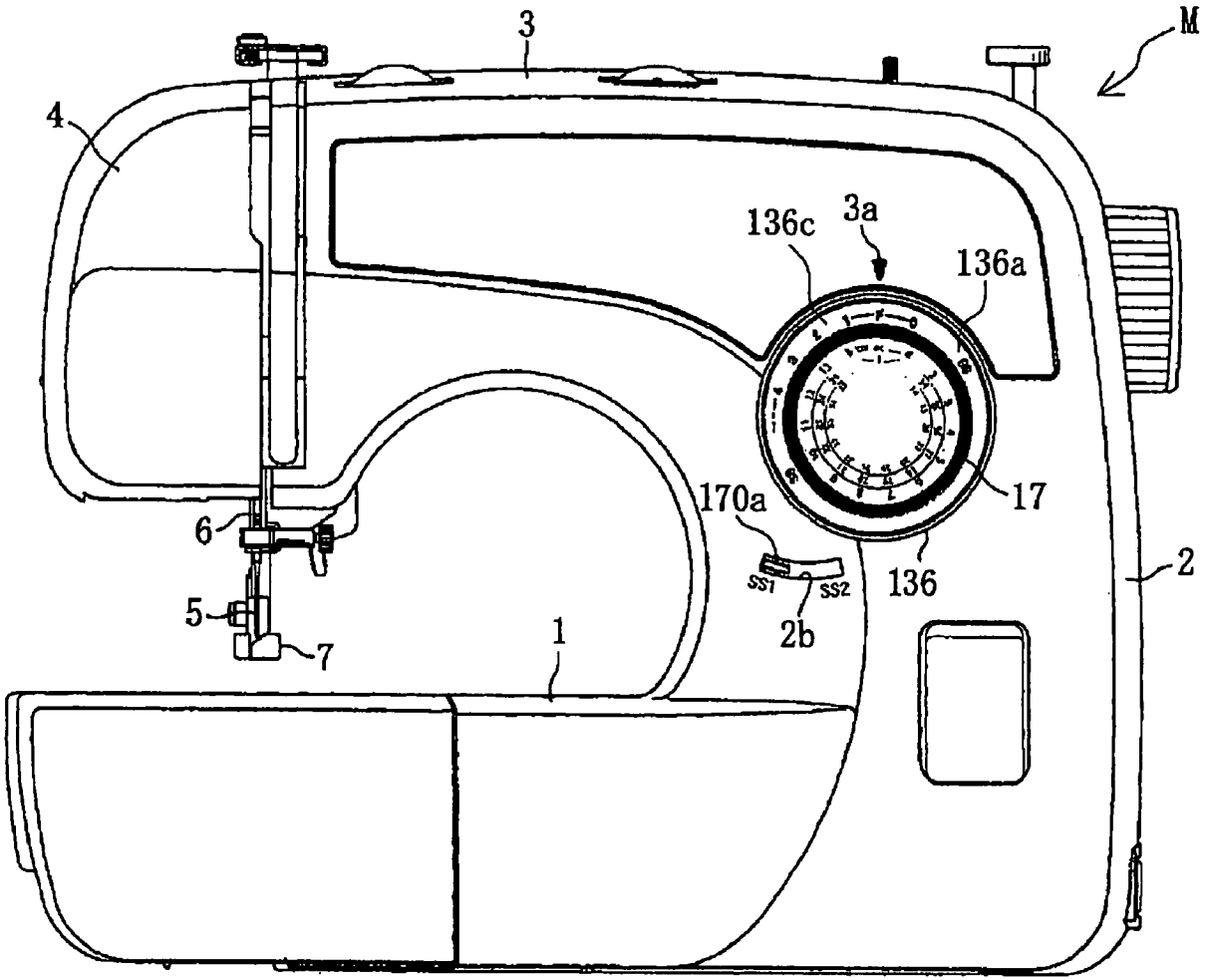
FIG. 20 is a view similar to FIG. 1, showing a zigzag sewing machine according to a second illustrative aspect of the invention.

An operator 170*a* formed by bending the switch operation lever 170 is provided on the lower portion of the switch operation lever 170. As shown in FIG. 20, the operator 170*a* protrudes to the front through a curved notch 2*b* formed on the front surface of the pillar 2. The user, by laterally swinging the operator 170*a* can in turn laterally swing the switch operation lever 170. Characters "SS1" and "SS2" are marked on the lower left and lower right portion of the notch 2*b* in the front surface of the pillar 2. The characters "SS1" and "SS2" indicate the locations to which the user's operation is to be made for the first and second super patterns respectively.

Figure 23:
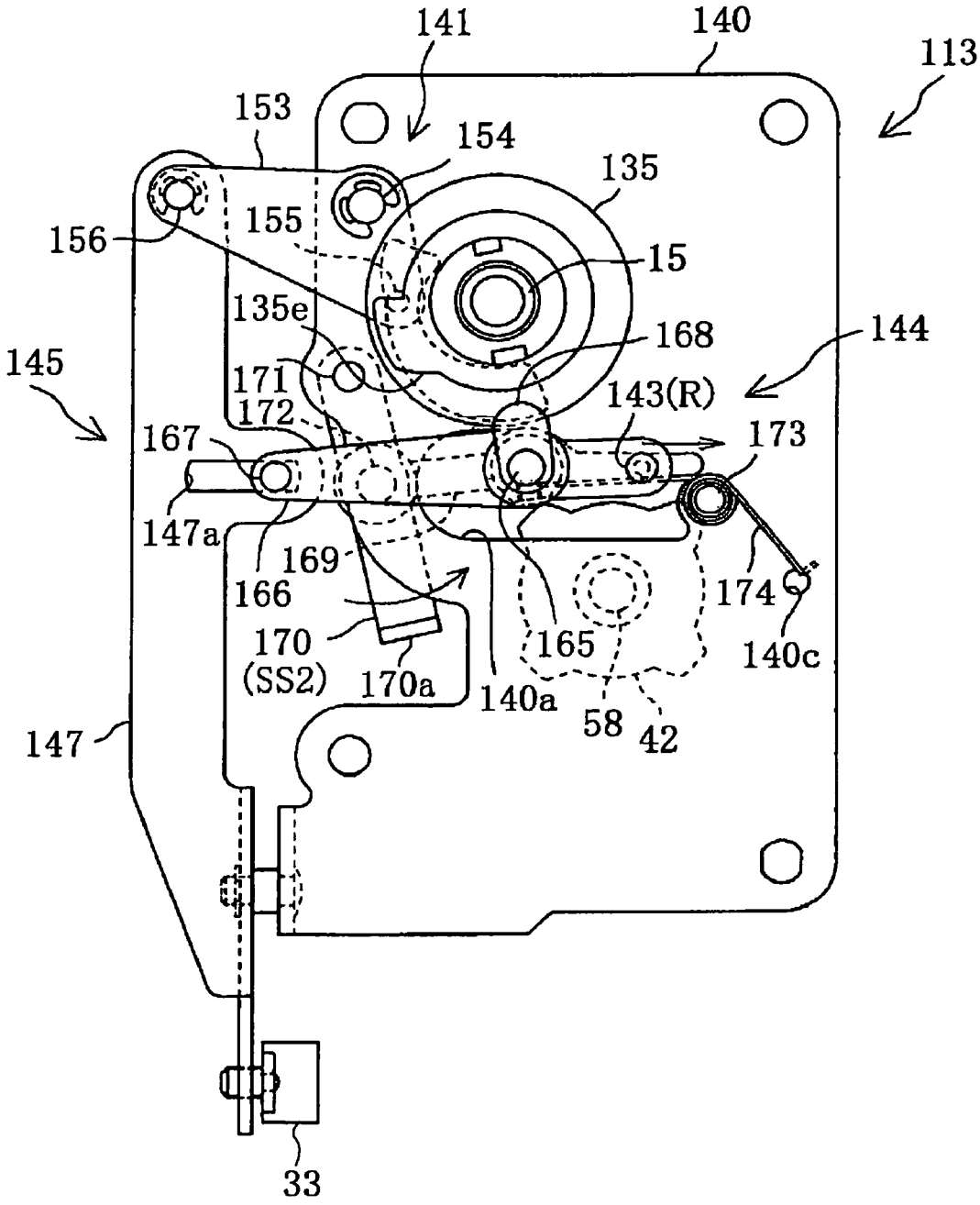
FIG. 23 is a front view of the feed generating device when the switch operation lever is in a second super pattern location.
Figure 24:
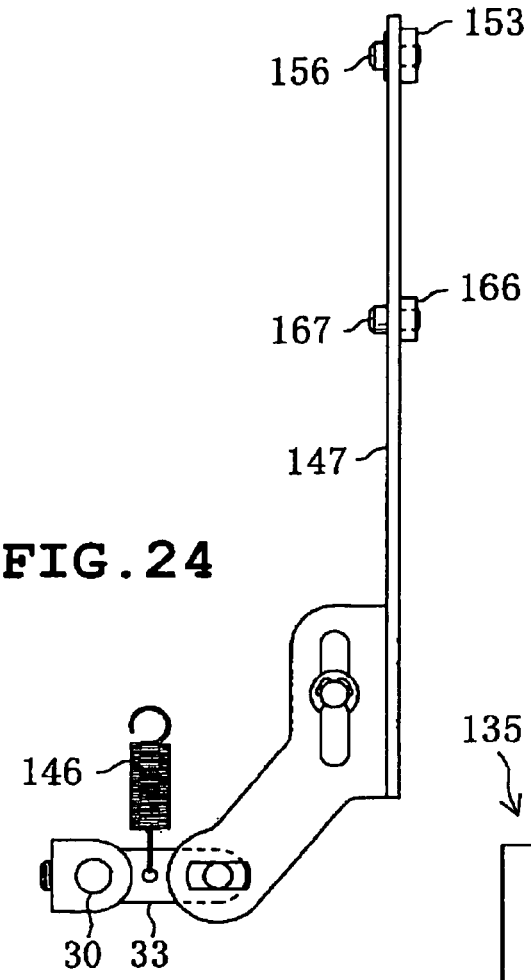
FIG. 24 is a view similar to FIG. 7.

FIG. 21 shows the operator 170*a* switched to the location SS1 (hereinafter referred to as a first operation location SS1) serving as the first super pattern; and likewise FIG. 23 shows the operator 170*a* operated to the location SS2 (a second operation location SS2) serving as the second super pattern. As shown in FIGS. 21 and 23, when the operator 170*a* is switched from the first operation location SS1 to the second operation location SS2, the cam detection lever 166 is moved to the right via the lever support 169 linked to the switch operation lever 170. Consequently, the super feed contact 143 is switched from a first super pattern generating location (L) in the left side to a second super pattern generating location (R) in the right side.

On the other hand, when the operator 170*a* is switched from the second operation location SS2 to the first operation location SS1, the super feed contact 143 is switched from the second super pattern generating position (R) in the right side to the first super pattern generating position (L) in the left side.

Also, as shown in FIGS. 21 and 27, the left end of the lever support 169 is linked to the vertical center of the switch operation lever 170 via a link pin 172. A spring stopper 173 is provided in the vertical center of the right front surface of the base frame 140. A torsion spring 174 is wound on the spring stopper 173.

One end of the torsion spring 174 is locked by the super feed contact 143 from below and the other end of the torsion spring 174 is locked to a lock hole 140*c* of the base frame 140. Therefore, the cam detection lever 166, supported by an engagement hole 147*a* via a link pin 167, is urged upward.

Now, in case a normal cloth feed amount (feed amount: 1, 2, 3, 4) is selected by the feed dial 136, as shown in FIGS. 21, 23, 29B and 30B, the cam contacting lever 168 does not contact the switching cam section 135*e*. Therefore, since the cam contact lever 166 is urged upward by the spring force of the torsion spring 174, the super feed contact 143 does not contact the super feed cam 42.

Figure 31A:
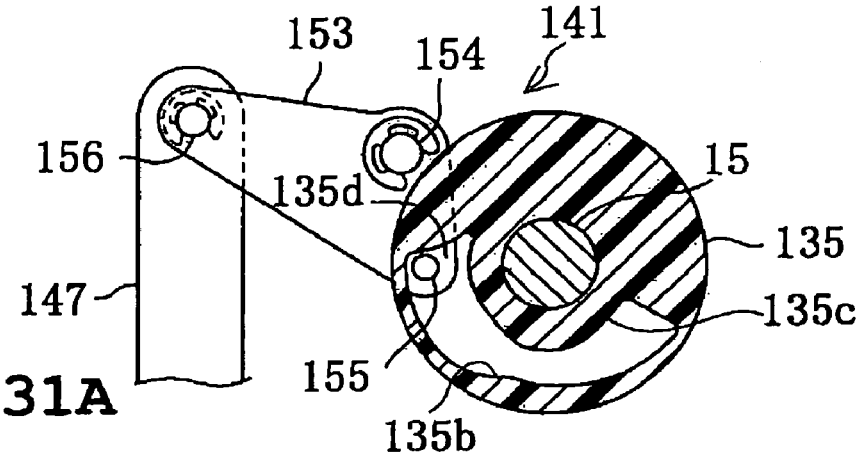
FIG. 31A is a front view of the utility feed generating mechanism upon forward cloth feed of the first super pattern.
Figure 31B:
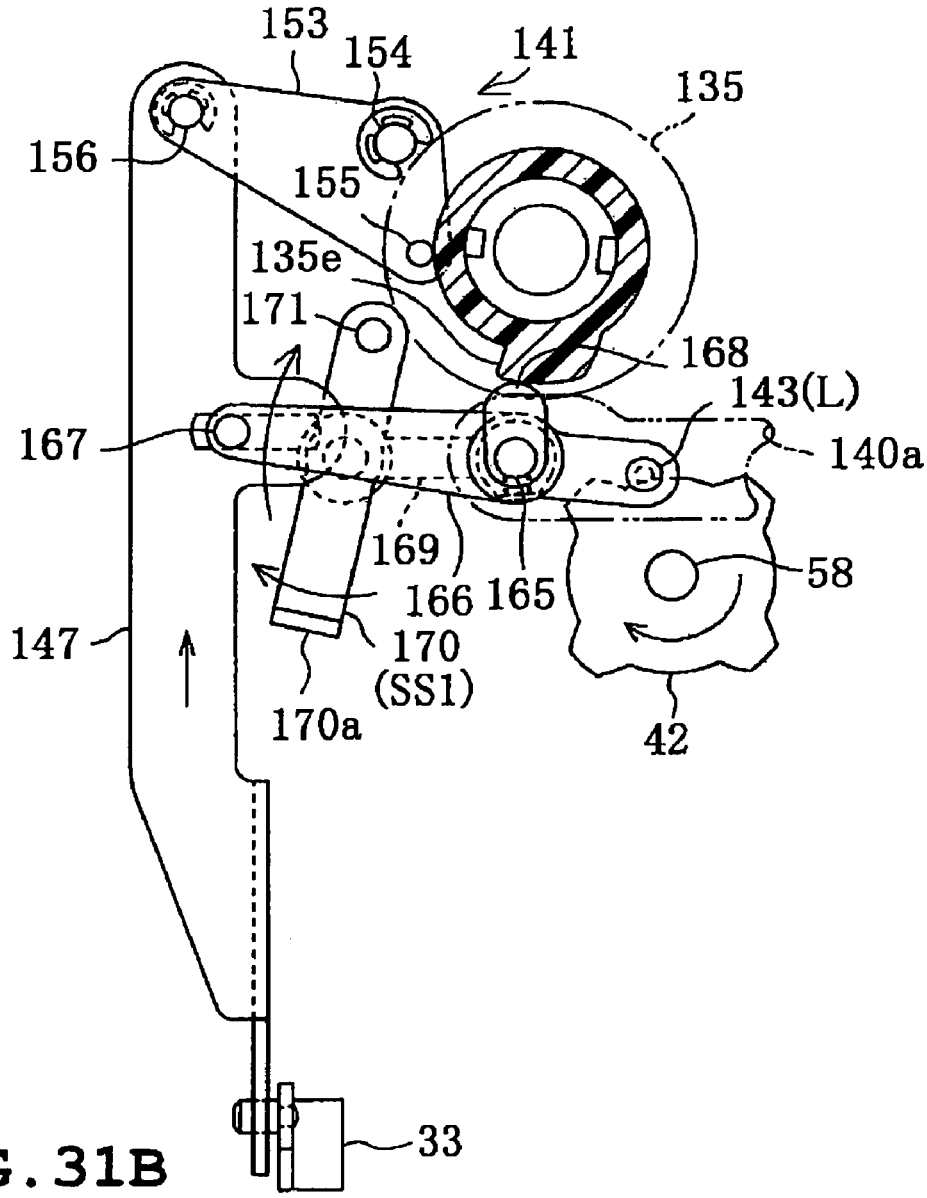
FIG. 31B is a front view of the feed generating mechanism upon forward cloth feed of the first super pattern.
Figure 33A:
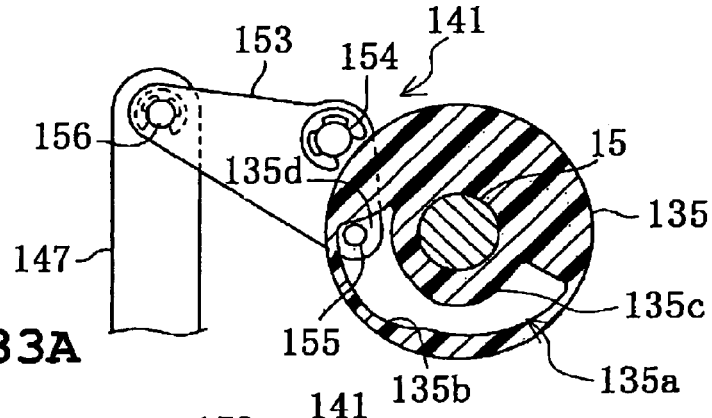
FIG. 33A is a front view of the utility feed generating mechanism upon forward cloth feed of the second super pattern.
Figure 33B:
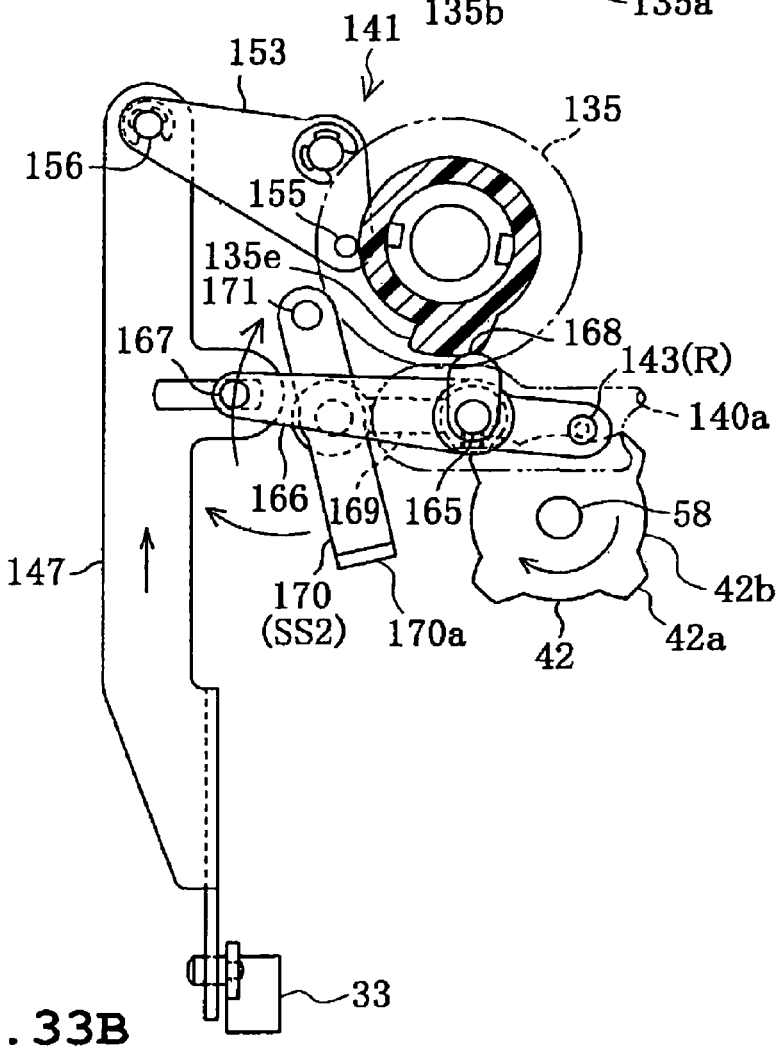
FIG. 33B is a front view of a feed generating mechanism upon forward cloth feed of the second super pattern.

However, when the super pattern is selected by the feed dial 136, as shown in FIGS. 31B and 33B, the cam contacting lever 168 contacts the switching cam section 135*e* and is pushed downward; hence the super feed contact 143 is moved downward in resistance to the spring force of the torsion spring 174 and contacts the super feed cam 42 from above.

At this point, the rotational center of the cam detection lever 166 is located by the lever support 169 and the cam contacting lever 168. Therefore, when the super feed cam 42 is rotationally driven with the super feed contact 143 contacting the super feed cam 42, the super feed contact 143 is vertically moved by the backward cam surfaces 42*a* and the forward cam surfaces 42*b* of the super feed cam 42. Thus, the cam detection lever 166 swings clockwise or counterclockwise with the link shaft 165 as the center and the feed generating plate 147 is moved vertically via a super feed generating mechanism 145, consequently executing the cyclic forward and backward feed movement of the workpiece cloth. At this point, the utility feed contact 155 is retracted to the retraction area 135*d* and the cloth feed movement for the utility pattern does not affect the cloth feed movement for the super pattern.

Next, the super feed generating mechanism 145 is described hereinafter. The super feed generating mechanism 145 generates the cloth feed for super patterns.

As described earlier, the link pin 167 in the left end of the cam detection lever 166 is engaged to the engagement hole 147*a* of the feed generating plate 147.

Figure 28:
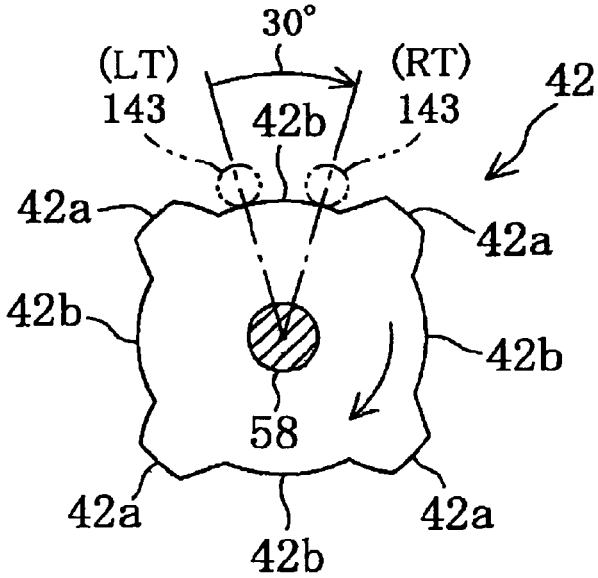
FIG. 28 is a view similar to FIG. 12.

Also, in case the switch operation lever 170 is switched to a first super pattern location SS1, the super feed contact 143 is located in the first super pattern generating location (L) in the left side. Therefore, in this state, when the super pattern is selected by the feed dial 36 and the cam detection lever 166 is pushed down, as shown in FIG. 28, the super feed contact 143 contacts the super feed cam 42 in a contact location (LT) for the first super pattern.

On the other hand, in case the switch operation lever 170 is switched to a second super pattern location SS2, the super feed contact 143 is located in the second super pattern generating location (R) in the right side. Therefore, in this state, when the super pattern is selected by the feed dial 36, the super feed contact 143 contacts the super feed cam 42 in a contact location (RT) for the second super pattern.

Now, the swing phases in the first and the second contact locations of the super feed contact 143 are described hereinafter. As shown in FIG. 28, there is approximately 30° phase difference between the swing phase of the first contact location (LT) and the second contact location (RT). That is, the second contact location (RT) leads the first contact location (LT) by 30° which corresponds to 1 stitch.

Therefore as opposed to a forward, backward, forward, forward, backward, forward . . . sequence of the cloth feed movement generated upon swinging of the super feed contact 143 when the super feed contact 143 is in the first contact location (LT), the cloth feed movement of forward, forward, backward forward, forward, backward . . . is generated upon swinging of the super feed contact 143 when the super feed contact 143 is in the second contact location (RT). That is, the generation of backward feed in the second contact location (RT) is delayed by 1 stitch as compared to the generation of backward feed in the first contact location (LT).

Figure 30A:
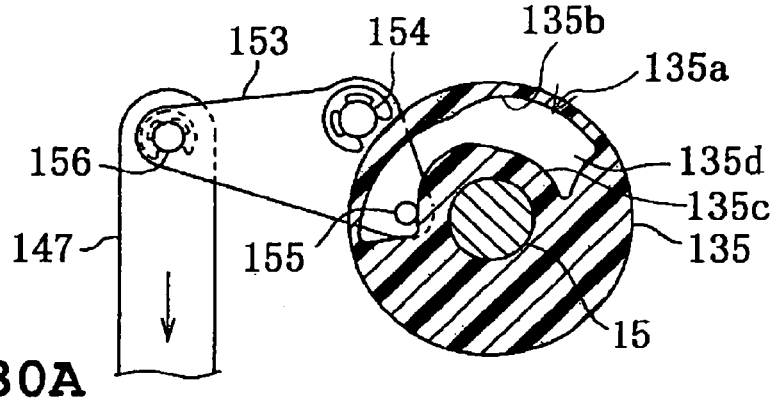
FIG. 30A is a front view of the feed generating mechanism upon backward cloth feed of the utility pattern.

Next, the operation and effect of the feed generating device 113 having the above construction is described hereinafter. In case of sewing a utility pattern, first the desired utility pattern is selected by the pattern selection dial 17. Then, the needle swinging contact is moved as to be paired with the predetermined needle swinging cam by the needle swinging contact moving mechanism and the needle swinging movement by the needle swinging mechanism is enabled. Also, when the feed amount for the utility pattern is set by the feed dial 136, the switch control cam 35 is integrally rotated with the feed dial 136. Thus, as shown in FIG. 29A, the contact location of the utility feed contact 155 with respect to the normal feed cam surface 135*b* of switch control cam 135 is changed. Consequently, the utility feed lever 153 is swung and the height of the feed generating plate 147 is changed thereby changing the forward feed amount. Also, upon back-tacking, as shown in FIG. 30A, the utility contact 155 contacts the reverse feed cam surface 135*c* and the switch is made to the reverse feed.

Figure 29B:
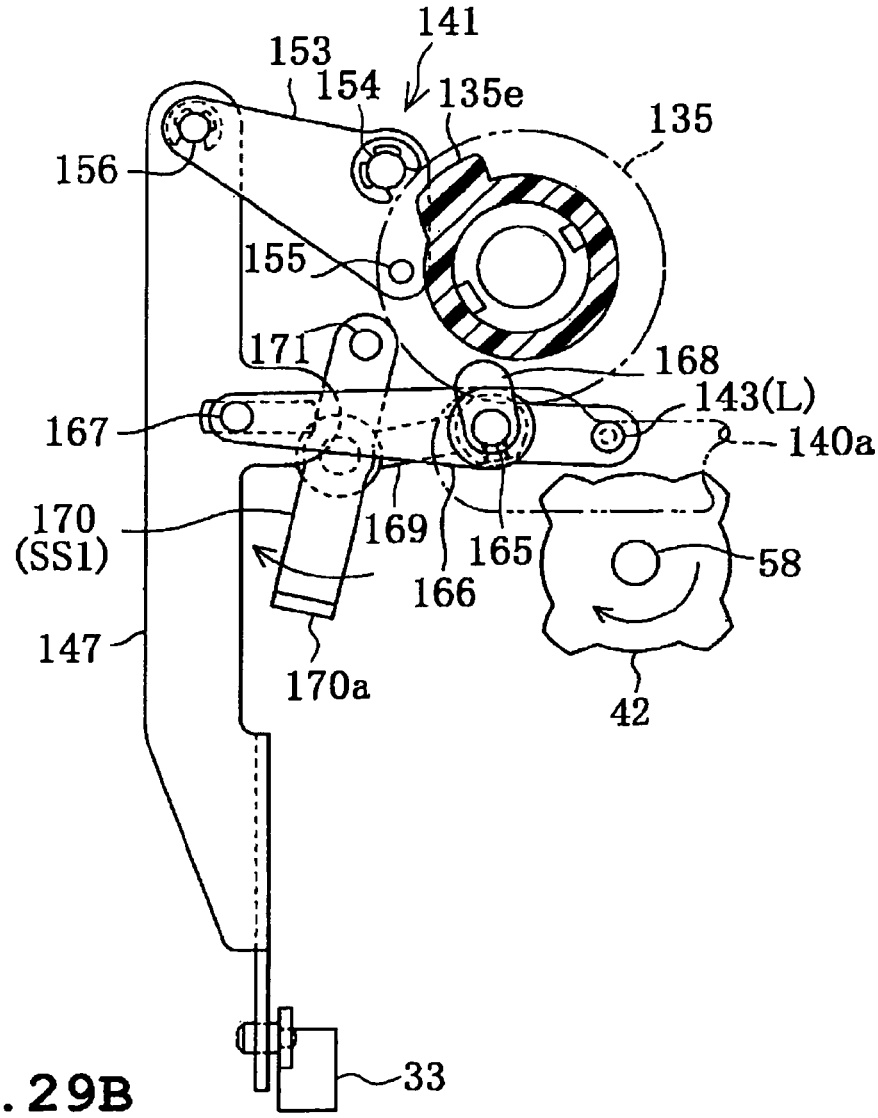
FIG. 29B is a front view of the feed generating mechanism upon forward cloth feed of the utility pattern.
Figure 30B:
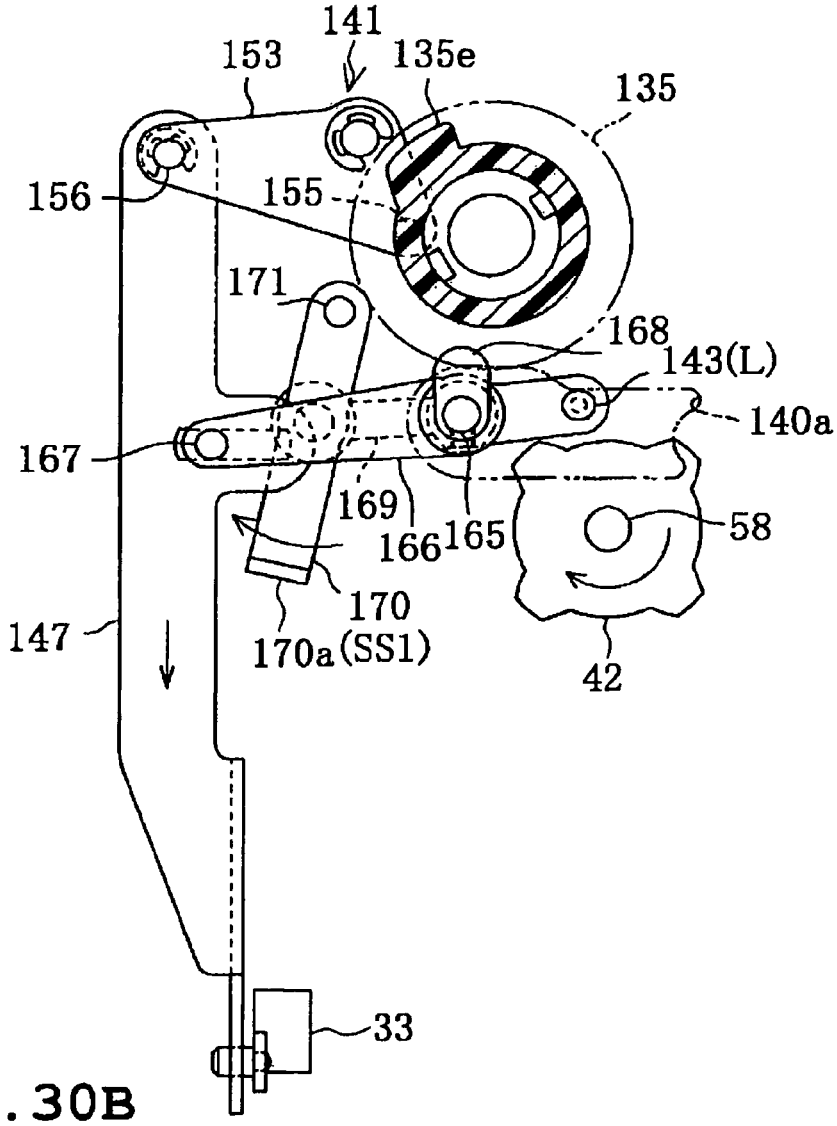
FIG. 30B is a front view of the utility feed generating device upon backward cloth feed of the utility pattern.

When the cloth feed amount for the utility pattern is thus selected by the feed dial 136, as shown in FIGS. 29B and 30B, the cam contacting lever 168 does not contact the switching cam section 135*e*. Therefore, the cloth feed movement for the super pattern does not affect the cloth feed movement for the utility pattern. As opposed to this, in case of sewing the first super pattern, the operator 170*a* of the switch operating lever 170 is switched to the first operation location SS1.

Then, the super feed contact 143 is switched to the first super pattern generating location (L) by the location switching mechanism 144. Under such state, the feed dial 136 is rotated counterclockwise beyond the setting range of the cloth feed amount for the utility patterns and an "SS" mark is matched with the selection mark 3*a*. Then, as shown in FIGS. 31B and 32B, the first super feed contact 143 contacts the super feed cam 42 from above in the first contact location (LT) in the left side. Consequently, the cam detection lever 166 swings with the link shaft 165 as a rotational center and the feed generating plate 147 is vertically moved.

That is, as shown in FIG. 31B, when the super feed contact 143 contacts the forward cam surface 42*b* of the super feed cam 42, the forward feed movement is performed and as shown in FIG. 32B, when the first feed contact 143 contacts the backward cam surface 42*a* of the super feed cam 42, the backward feed movement is performed.

Figure 32A:
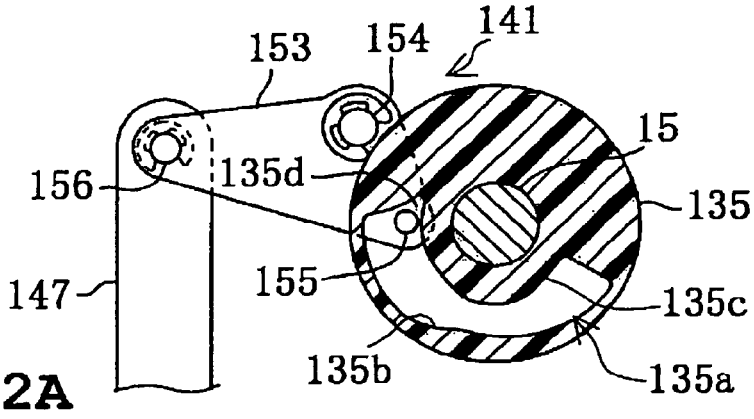
FIG. 32A is a front view of the feed generating mechanism upon backward cloth feed of the first super pattern.
Figure 32B:
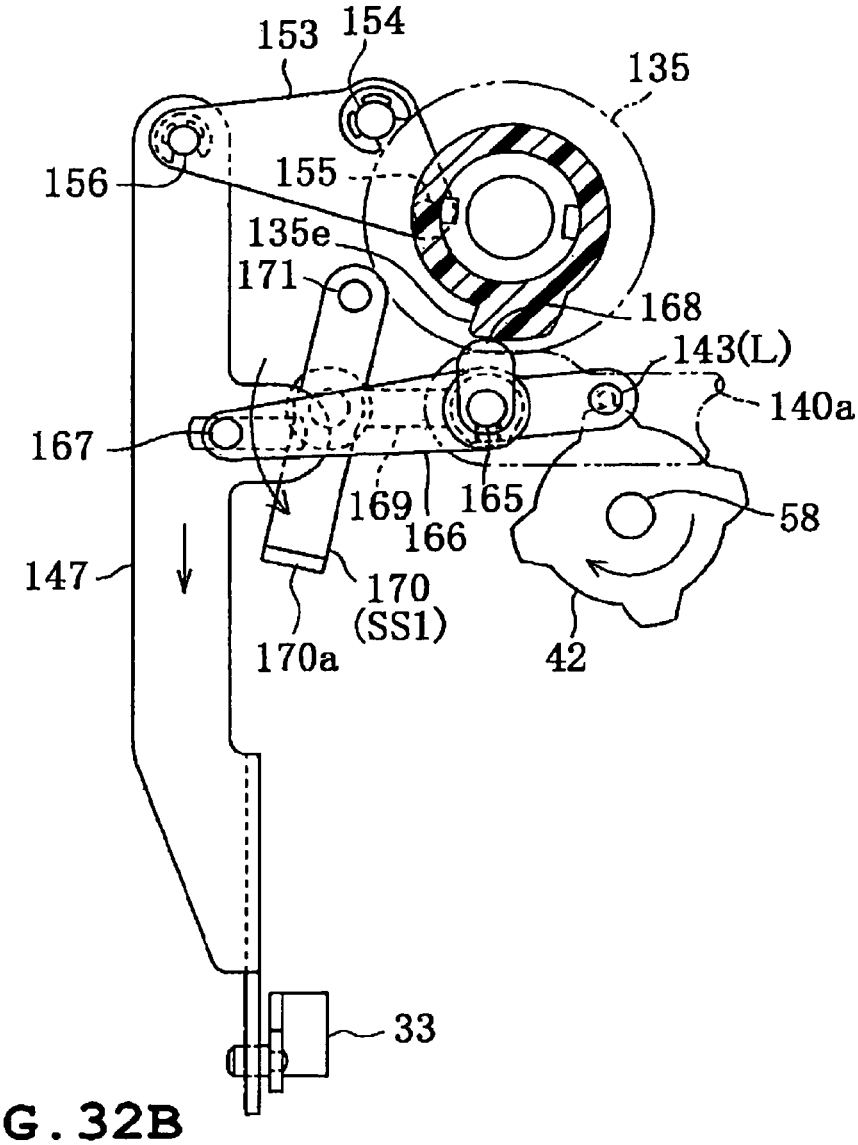
FIG. 32B is a front view of the utility feed generating device upon backward cloth feed of the first super pattern.

At this point, as shown in FIGS. 31A and 32A, the utility feed contact 155 is retracted in the retraction area 135*d* of the utility feed cam 135*a*. Therefore, the cloth feed movement for the utility pattern does not affect the cloth feed movement for the first super pattern.

On the other hand, in case of sewing the second super pattern, the operating lever 170 is switched to the second super pattern location SS2. Then, the super feed contact 143 is switched to the second super pattern generating location (R) by the location switching mechanism 144. Consequently, as shown in FIGS. 33B and 34B, the first super feed contact 143 contacts the super feed cam 42 from above in the second contact location (RT) in the right side. Thus, the cam detection lever 166 swings with the link shaft 165 as the rotational center and the feed generating plate 147 is vertically moved.

That is, as shown in FIG. 33B, when the super feed contact 143 contacts the forward cam surface 42*b* of the super feed cam 42, the forward feed movement is performed; and likewise, as shown in FIG. 32B, when the first feed contact 143 contacts the backward cam surface 42*a* of the super feed cam 42, the backward feed movement is performed.

Figure 34A:
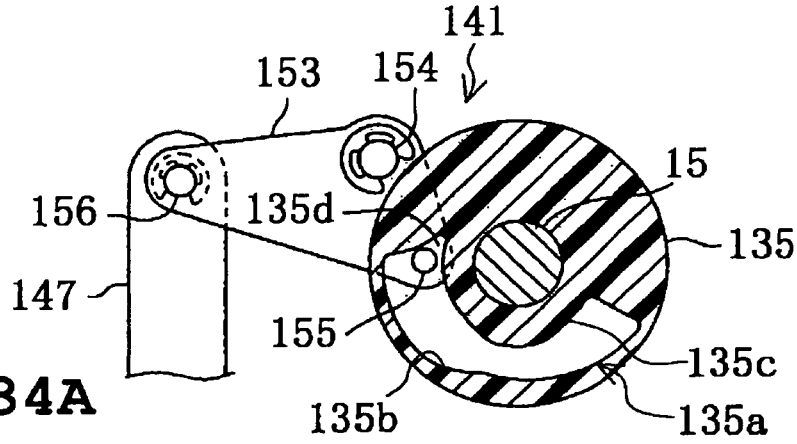
FIG. 34A is a front view of the feed generating mechanism upon backward cloth feed of the second super pattern.
Figure 34B:
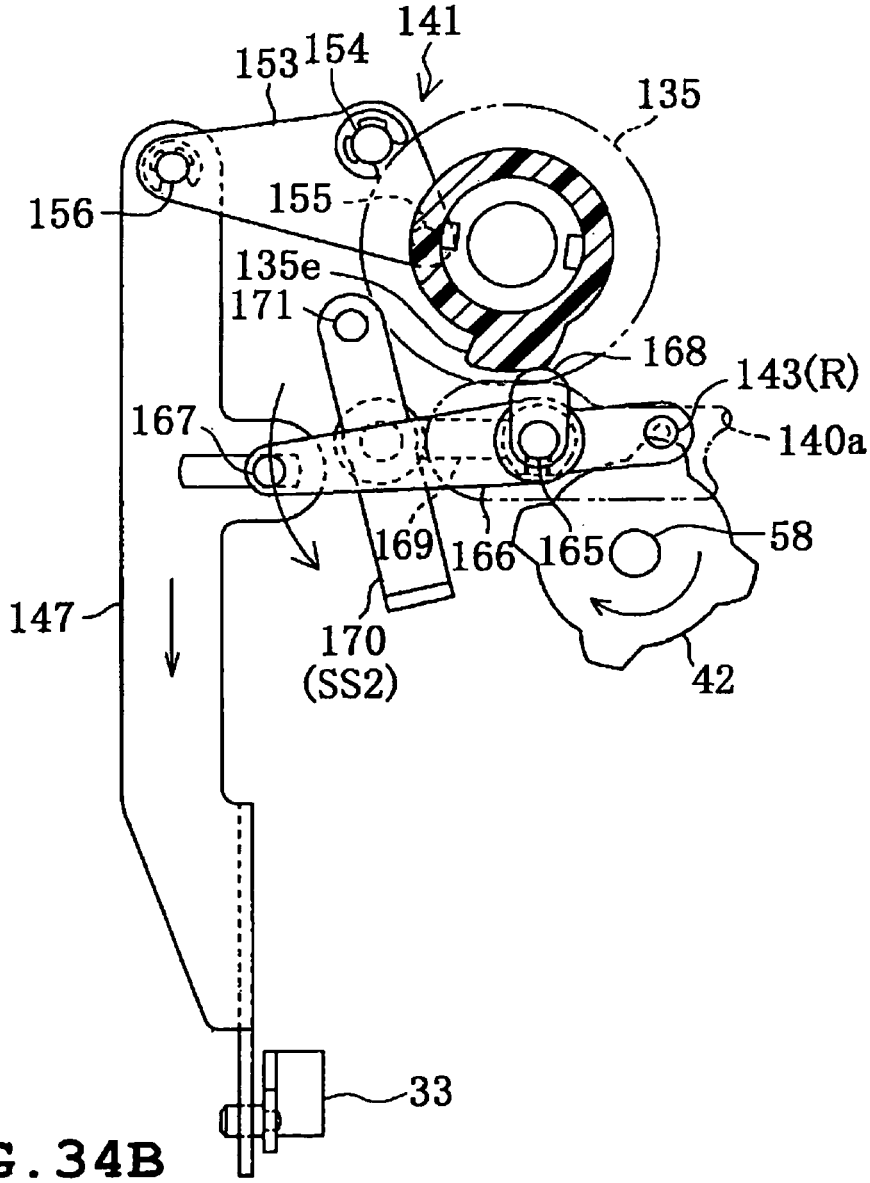
FIG. 34B is a front view of the utility feed generating device upon backward cloth feed of the second super pattern.

At this point, as shown in FIGS. 33A and 34A, since the utility feed contact 155 is retracted in the retraction area 135*d* of the utility feed cam 135*a*, the cloth feed movement for the utility pattern does not affect the cloth feed movement for the second super pattern.

As described before, displacement of approximately 30° exists between the swing phase of the super feed contact 143 in the first contact location (LT) and the second contact location (RT). That is, the generation of backward feed by the super feed contact 143 in the second super pattern generating location (R) is delayed by 1 stitch as compared to the generation of backward feed by the super feed contact 143 in the first super pattern generating location (L).

Figure 35:
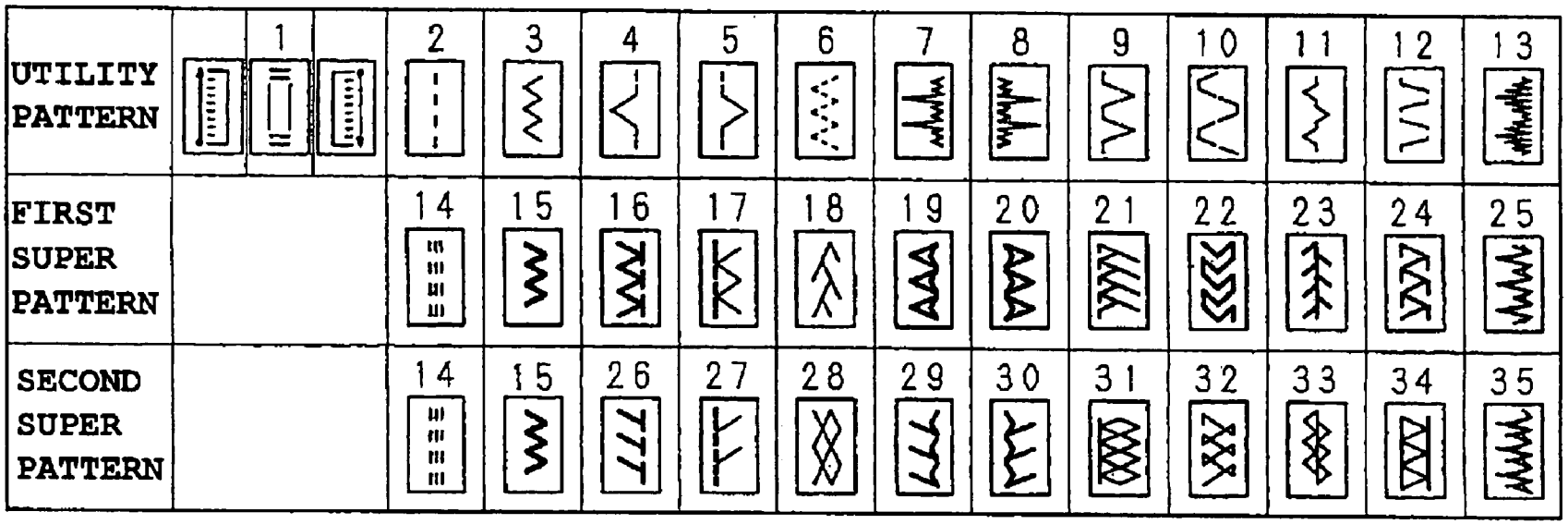
FIG. 35 is a view similar to FIG. 19.

Therefore in case the utility pattern indicated by number "6" in FIG. 35 is selected as the utility pattern for example, and the switching lever 170 is switched to the first super pattern location SS1, a forward, backward, forward, forward, backward, forward . . . sequence of the cloth feed movement is performed. Thus, the first super pattern indicated by "18" in FIG. 35 is sewn. As opposed to this, in case the switching lever 170 is switched to the second super pattern location SS2, forward, forward, backward forward, forward, backward . . . sequence of the cloth feed movement is performed. Thus, the second super pattern indicated by "28" in FIG. 35 is sewn.

Thus, in the present embodiment, the super feed contact 143 that contacts a single super feed cam 42 in the first and the second contact locations of different swing phases have been provided. By switching the location of the super feed contact 143 by the location switching mechanism 144, the super feed contact 143 is arranged to contact the super feed cam 42 in either one of the first or the second contact locations. Therefore, size and weight reduction of the feed generating device 113 can be achieved all the more. The present invention is not limited to the above described embodiments but, can be transformed as follows.

Three or more super feed contacts may be provided around the single super feed cam and one of such plurality of super feed contacts may be arranged to contact the single super feed cam.

Three or more arrangement locations can be provided on the outer circumference of the super feed cam and the super feed contact may be arranged in one of such plurality of arrangement locations.

While providing multiple super feed contacts around a single super feed cam, a plurality of arrangement locations can be provided with respect to each of the super feed contact and one of such super feed contacts may be arranged in one of the plurality of arrangement locations by the switching mechanism, so as to contact the super feed cam.

The switch operation lever can be switched to either one of the first pattern location and the second pattern location by an electronically driven actuator such as a solenoid.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

We claim:

1. A feed generating device of a sewing machine capable of selectively sewing either one of a plurality of utility patterns and a plurality of super patterns comprising:

a single super feed cam for generating a cloth feed movement that sews the super patterns wherein the cloth feed movement is a combination of a forward feed movement and a backward feed movement;

a plurality of feed contacts arranged so as to be capable of contacting the super feed cam in either one of a plurality of contact locations having different swing phases with respect to the super feed cam;

a switching mechanism that generates the cloth feed movements having different patterns of combinations of the forward feed and the backward feed by moving the feed contacts to either one of the contact locations.

2. The feed generating device according to claim 1, provided with an operator for operating the switching mechanism.

3. A feed generating device of a sewing machine capable of selectively sewing either one of a plurality of sewing patterns including a plurality of utility patterns and plurality of super patterns comprising:

a single super feed cam for generating a cloth feed movement that sews the super patterns wherein the cloth feed movement is a combination of a forward feed movement and a backward feed movement;

a plurality of feed contacts capable of contacting the super feed cam in locations having different swing phases with respect to the super cam;

a contact switching mechanism that generates the cloth feed movements having different patterns of combinations of the forward feed movement and the backward feed movement by moving one of a plurality of feed contacts to the super feed cam.

4. The feed generating device according to claim 3, provided with a switching operator for operating the contact switching mechanism.

5. The feed generating device according to claim 4, wherein the sewing machine is provided with a pattern selection dial for selecting one of a plurality of sewing patterns and the switching operator is constructed of a member with a center thereof comprising a central shaft of the pattern selection dial.

6. The feed generating device according to claim 5, wherein the sewing machine is provided with a feed amount adjustment dial for adjusting the feed amount of the plurality of utility patterns by rotating the feed adjustment dial within a setting range and the switch operation mechanism is constructed integrally with the feed adjustment dial whereupon rotating the feed adjustment dial beyond the setting range, the contact switching mechanism moves one of a plurality of feed contacts to a contact location.

7. The feed generating device according to claim 6, wherein, the contact switching mechanism is provided with a switch control cam having a plurality of cam portions moving one of a plurality of feed contacts to the contact location.

* * * * *